US007271791B2

(12) United States Patent
Yamazaki

(10) Patent No.: US 7,271,791 B2
(45) Date of Patent: Sep. 18, 2007

(54) IMAGE DISPLAY METHOD, IMAGE DISPLAY DEVICE, AND ELECTRONIC EQUIPMENT

(75) Inventor: Katsunori Yamazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 493 days.

(21) Appl. No.: 10/291,733

(22) Filed: Nov. 12, 2002

(65) Prior Publication Data

US 2003/0090500 A1 May 15, 2003

(30) Foreign Application Priority Data

Nov. 12, 2001 (JP) ..... 2001-345544
Jul. 9, 2002 (JP) ..... 2002-200420

(51) Int. Cl.
*G09G 3/36* (2006.01)
*G09G 5/10* (2006.01)

(52) U.S. Cl. ..... 345/89; 345/690

(58) Field of Classification Search ..... 345/204, 345/690, 213, 87, 202, 97
See application file for complete search history.

(56) References Cited

U.S. PATENT DOCUMENTS 5,446,496 A * 8/1995 Foster et al. ..... 348/441
5,861,879 A * 1/1999 Shimizu et al. ..... 345/213
6,054,980 A * 4/2000 Eglit ..... 345/204
6,853,381 B1 * 2/2005 Grigor et al. ..... 345/531
2002/0036611 A1 * 3/2002 Ishii ..... 345/89

FOREIGN PATENT DOCUMENTS

| | | |
|---|---|---|
| EP | 1 011 087 A1 | 6/2000 |
| JP | A-3-144491 | 6/1991 |
| JP | A-11-338425 | 12/1999 |
| JP | A-2000-013639 | 1/2000 |
| JP | A-2000-310985 | 11/2000 |
| JP | A-2001-067060 | 3/2001 |

* cited by examiner

*Primary Examiner*—Sumati Lefkowitz
*Assistant Examiner*—Srilakshmi K Kumar
(74) *Attorney, Agent, or Firm*—Oliff & Berridge, PLC

(57) ABSTRACT

The invention prevents display tearing involved with refreshing of a display memory when grayscale data corresponding to a pixel is read from the display memory and is displayed on a display panel. If a refresh has occurred during a reading and scanning operation of a display memory, a display controller skips the reading operation of the grayscale data corresponding to rows subsequent to the row which was being read and scanned when the refresh occurred. The content from a frame immediately before the frame in which the refresh occurred is maintained in the skipped pixel.

9 Claims, 20 Drawing Sheets

<Y DRIVER SIDE>
(a)
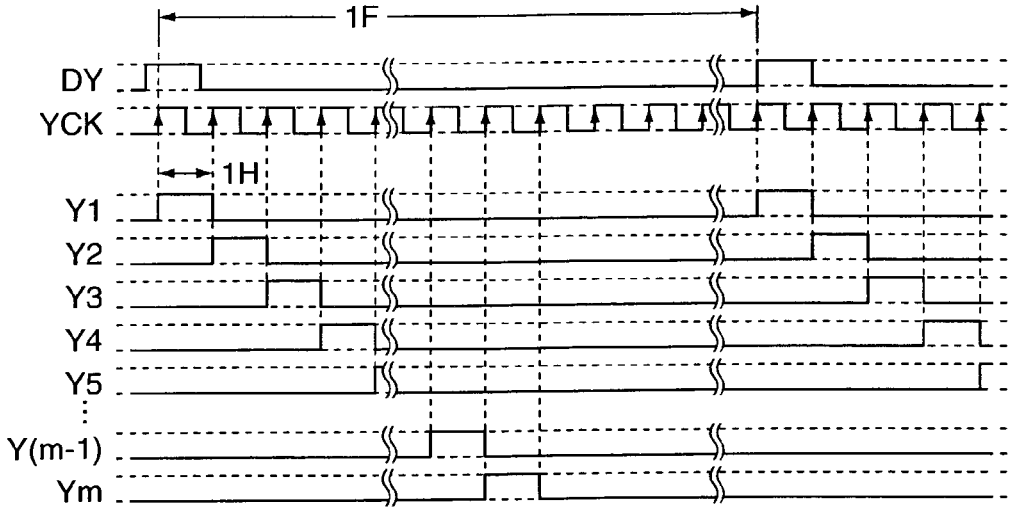
(b)
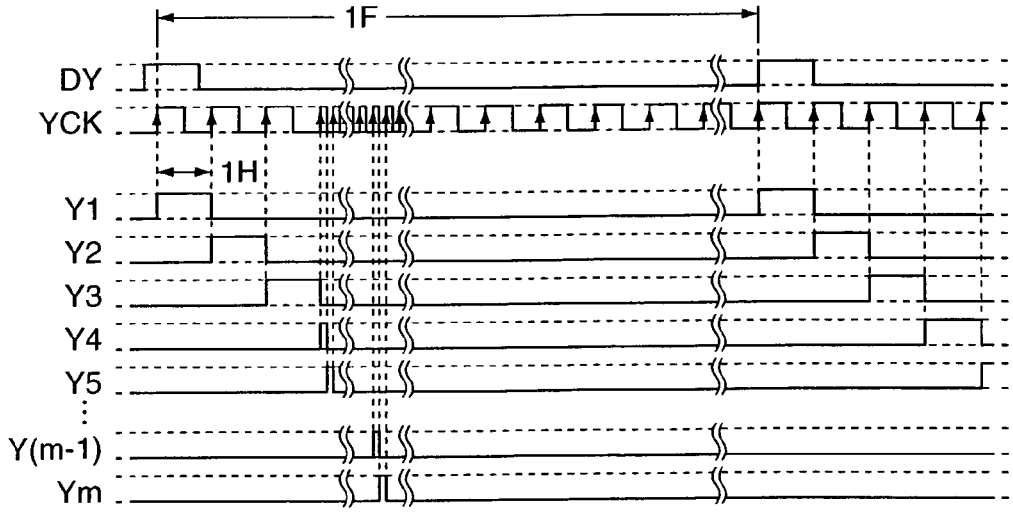
FIG. 4

(a)

| | FRAME 1 | FRAME 2 | FRAME 3 | FRAME 4 | FRAME 5 | FRAME 6 | FRAME 7 | FRAME 8 | FRAME 9 | FRAME 10 |
|---|---|---|---|---|---|---|---|---|---|---|
| 1ST ROW | A | A | A | B | B | B | B | C | C | C |
| 2ND ROW | A | A | A | B | B | B | B | C | C | C |
| 3RD ROW | A | A | A | B | B | B | B | C | C | C |
| 4TH ROW | A | A | A | B | B | B | B | C | C | C |
| 5TH ROW | A | A | A | B | B | B | B | C | C | C |
| 6TH ROW | A | A | A | B | B | B | B | C | C | C |
| 7TH ROW | A | A | A | B | B | B | B | C | C | C |
| 8TH ROW | A | A | A | B | B | B | B | C | C | D |
| 9TH ROW | A | A | B | B | B | B | B | C | C | D |
| 10TH ROW | A | A | B | B | B | B | B | C | C | D |
| 11TH ROW | A | A | B | B | B | B | C | C | C | D |
| 12TH ROW | A | A | B | B | B | B | C | C | C | D |
| 13TH ROW | A | A | B | B | B | B | C | C | C | D |
| 14TH ROW | A | A | B | B | B | B | C | C | C | D |
| 15TH ROW | A | A | B | B | B | B | C | C | C | D |
| 16TH ROW | A | A | B | B | B | B | C | C | C | D |
| 17TH ROW | A | A | B | B | B | B | C | C | C | D |
| 18TH ROW | A | A | B | B | B | B | C | C | C | D |

(b)

| | FRAME 1 | FRAME 2 | FRAME 3 | FRAME 4 | FRAME 5 | FRAME 6 | FRAME 7 | FRAME 8 | FRAME 9 | FRAME 10 |
|---|---|---|---|---|---|---|---|---|---|---|
| 1ST ROW | A | A | A | B | B | B | B | C | C | C |
| 2ND ROW | A | A | A | B | B | B | B | C | C | C |
| 3RD ROW | A | A | A | B | B | B | B | C | C | C |
| 4TH ROW | A | A | A | B | B | B | B | C | C | C |
| 5TH ROW | A | A | A | B | B | B | B | C | C | C |
| 6TH ROW | A | A | A | B | B | B | B | C | C | C |
| 7TH ROW | A | A | A | B | B | B | B | C | C | C |
| 8TH ROW | A | A | A | B | B | B | B | C | C | ↓ |
| 9TH ROW | A | A | ↓ | B | B | B | B | C | C | ↓ |
| 10TH ROW | A | A | ↓ | B | B | B | B | C | C | ↓ |
| 11TH ROW | A | A | ↓ | B | B | B | ↓ | C | C | ↓ |
| 12TH ROW | A | A | ↓ | B | B | B | ↓ | C | C | ↓ |
| 13TH ROW | A | A | ↓ | B | B | B | ↓ | C | C | ↓ |
| 14TH ROW | A | A | ↓ | B | B | B | ↓ | C | C | ↓ |
| 15TH ROW | A | A | ↓ | B | B | B | ↓ | C | C | ↓ |
| 16TH ROW | A | A | ↓ | B | B | B | ↓ | C | C | ↓ |
| 17TH ROW | A | A | ↓ | B | B | B | ↓ | C | C | ↓ |
| 18TH ROW | A | A | ↓ | B | B | B | ↓ | C | C | ↓ |

FIG. 9

Mod = 0 : N MODE
= 1 : W MODE
= 2 : X MODE
= 3 : S MODE

L-1 ~ L-m
= 0 : POSITIVE POLARITY
= 1 : NEGATIVE POLARITY

| | FRAME 1 | FRAME 2 | FRAME 3 | FRAME 4 | FRAME 5 | FRAME 6 | FRAME 7 | FRAME 8 | FRAME 9 | FRAME 10 | FRAME 11 | FRAME 12 | FRAME 13 | FRAME 14 | FRAME 15 | FRAME 16 | FRAME 17 | FRAME 18 | FRAME 19 |
|---|---|---|---|---|---|---|---|---|---|---|---|---|---|---|---|---|---|---|---|
| Mod | N | N | N/W | X | S | N | N/W | X | S | N/W | Z | S/W | X | S | N/W | X | S/W | X | S/W |
| 1ST ROW | A+ | A- | A+ | B- | B+ | B- | B+ | C- | C+ | C- | D+ | D- | E+ | E- | E+ | F- | F+ | G- | G+ |
| 2ND ROW | A+ | A- | A+ | B- | B+ | B- | B+ | C- | C+ | C- | D+ | D- | E+ | E- | E+ | F- | F+ | G- | G+ |
| 3RD ROW | A+ | A- | A+ | B- | B+ | B- | B+ | C- | C+ | C- | D+ | D- | E+ | E- | E+ | F- | F+ | G- | G+ |
| 4TH ROW | A+ | A- | A+ | B- | B+ | B- | B+ | C- | C+ | C- | D+ | D- | E+ | E- | E+ | F- | F+ | G- | G+ |
| 5TH ROW | A+ | A- | A+ | B- | B+ | B- | B+ | C- | C+ | C- | D+ | ← | E- | ← | E+ | F- | F+ | G- | G+ |
| 6TH ROW | A+ | A- | A+ | B- | B+ | B- | B+ | C- | C+ | C- | D+ | ← | E- | ← | E+ | F- | F+ | G- | G+ |
| 7TH ROW | A+ | A- | A+ | B- | B+ | B- | B+ | C- | C+ | C- | D+ | ← | E- | ← | E+ | F- | ← | G+ | ← |
| 8TH ROW | A+ | A- | A+ | B- | B+ | B- | B+ | C- | C+ | ← | D- | ← | E+ | E- | E+ | F- | ← | G+ | ← |
| 9TH ROW | A+ | A- | ← | B+ | ← | B- | B+ | C- | C+ | ← | D- | ← | E+ | E- | ← | F+ | ← | G- | G+ |
| 10TH ROW | A+ | A- | ← | B+ | ← | B- | B+ | C- | C+ | ← | D- | ← | E+ | E- | ← | F+ | ← | G- | G+ |
| 11TH ROW | A+ | A- | ← | B+ | ← | B- | ← | C+ | ← | ← | D- | ← | E+ | E- | ← | F+ | ← | G- | G+ |
| 12TH ROW | A+ | A- | ← | B+ | ← | B- | ← | C+ | ← | ← | D- | ← | E+ | E- | ← | F+ | ← | G- | G+ |
| 13TH ROW | A+ | A- | ← | B+ | ← | B- | ← | C+ | ← | ← | D- | ← | E+ | E- | ← | F+ | ← | G- | ← |
| 14TH ROW | A+ | A- | ← | B+ | ← | B- | ← | C+ | ← | ← | D- | ← | E+ | E- | ← | F+ | ← | G- | ← |
| 15TH ROW | A+ | A- | ← | B+ | ← | B- | ← | C+ | ← | ← | D- | ← | E+ | E- | ← | F+ | ← | G- | ← |
| 16TH ROW | A+ | A- | ← | B+ | ← | B- | ← | C+ | ← | ← | D- | ← | E+ | E- | ← | F+ | ← | G- | ← |
| 17TH ROW | A+ | A- | ← | B+ | ← | B- | ← | C+ | ← | ← | D- | ← | E+ | E- | ← | F+ | ← | G- | ← |
| 18TH ROW | A+ | A- | ← | B+ | ← | B- | ← | C+ | ← | ← | D- | ← | E+ | E- | ← | F+ | ← | G- | ← |

INHERENT WRITE POLARITY

ODD-NUMBERED FRAME : POSITIVE POLARITY

EVEN-NUMBERED FRAME: NEGATIVE POLARITY

FIG. 17

| | FRAME 1 | FRAME 2 | FRAME 3 | FRAME 4 | FRAME 5 | FRAME 6 | FRAME 7 | FRAME 8 | FRAME 9 | FRAME 10 | FRAME 11 | FRAME 12 | FRAME 13 | FRAME 14 | FRAME 15 | FRAME 16 | FRAME 17 | FRAME 18 | FRAME 19 |
|---|---|---|---|---|---|---|---|---|---|---|---|---|---|---|---|---|---|---|---|
| Mod | N | N | N W | X | S | N | N W | X | S | N W | Z | S W | X | S | N W | X | S W | X | S W |
| 1ST ROW | A+ | A- | A+ | B- | B+ | B- | B+ | C- | C+ | C- | D+ | D- | E+ | E- | E+ | F- | F+ | G- | G+ |
| 2ND ROW | A- | A+ | A- | B+ | B- | B+ | B- | C+ | C- | C+ | D- | D+ | E- | E+ | E- | F+ | F- | G+ | G- |
| 3RD ROW | A+ | A- | A+ | B- | B+ | B- | B+ | C- | C+ | C- | D+ | D- | E+ | E- | E+ | F- | F+ | G- | G+ |
| 4TH ROW | A- | A+ | A- | B+ | B- | B+ | B- | C+ | C- | C+ | D- | D+ | E- | E+ | E- | F+ | F- | G+ | G- |
| 5TH ROW | A+ | A- | A+ | B- | B+ | B- | B+ | C- | C+ | C- | D+ | ← | E- | ← | E+ | F- | F+ | G- | G+ |
| 6TH ROW | A- | A+ | A- | B+ | B- | B+ | B- | C+ | C- | C+ | D- | ← | E+ | ← | E- | F+ | F- | G+ | G- |
| 7TH ROW | A+ | A- | A+ | B- | B+ | B- | B+ | C- | C+ | C- | D+ | ← | E- | ← | E+ | F- | ← | G+ | ← |
| 8TH ROW | A- | A+ | A- | B+ | B- | B+ | B- | C+ | C- | ← | D+ | ← | E- | E+ | E- | F+ | ← | G- | ← |
| 9TH ROW | A+ | A- | ← | B+ | ← | B- | B+ | C- | C+ | ← | D- | ← | E+ | E- | ← | F+ | ← | G- | G+ |
| 10TH ROW | A- | A+ | ← | B- | ← | B+ | B- | C+ | C- | ← | D+ | ← | E- | E+ | ← | F- | ← | G+ | G- |
| 11TH ROW | A+ | A- | ← | B+ | ← | B- | ← | C+ | ← | ← | D- | ← | E+ | E- | ← | F+ | ← | G- | G+ |
| 12TH ROW | A- | A+ | ← | B- | ← | B+ | ← | C- | ← | ← | D+ | ← | E- | E+ | ← | F- | ← | G+ | G- |
| 13TH ROW | A+ | A- | ← | B+ | ← | B- | ← | C+ | ← | ← | D- | ← | E+ | E- | ← | F+ | ← | G- | ← |
| 14TH ROW | A- | A+ | ← | B- | ← | B+ | ← | C- | ← | ← | D+ | ← | E- | E+ | ← | F- | ← | G+ | ← |
| 15TH ROW | A+ | A- | ← | B+ | ← | B- | ← | C+ | ← | ← | D- | ← | E+ | E- | ← | F+ | ← | G- | ← |
| 16TH ROW | A- | A+ | ← | B- | ← | B+ | ← | C- | ← | ← | D+ | ← | E- | E+ | ← | F- | ← | G+ | ← |
| 17TH ROW | A+ | A- | ← | B+ | ← | B- | ← | C+ | ← | ← | D- | ← | E+ | E- | ← | F+ | ← | G- | ← |
| 18TH ROW | A- | A+ | ← | B- | ← | B+ | ← | C- | ← | ← | D+ | ← | E- | E+ | ← | F- | ← | G+ | ← |

INHERENT WRITE POLARITY

ODD-NUMBERED FRAME
ODD-NUMBERED ROW
: POSITIVE POLARITY
EN-NUMBERED ROW
: NEGATIVE POLARITY

EVEN-NUMBERED FRAME
ODD-NUMBERED ROW
: NEGATIVE POLARITY
EVEN-NUMBERED ROW
: POSITIVE POLARITY

FIG. 18

| Mod | FRAME 1 | FRAME 2 | FRAME 3 | FRAME 4 | FRAME 5 | FRAME 6 | FRAME 7 | FRAME 8 | FRAME 9 | FRAME 10 | FRAME 11 | FRAME 12 | FRAME 13 | FRAME 14 | FRAME 15 | FRAME 16 | FRAME 17 | FRAME 18 | FRAME 19 |
|---|---|---|---|---|---|---|---|---|---|---|---|---|---|---|---|---|---|---|---|
| | N | N | N W | X | S | N | N W | X | S | N W | N | S W | X | S | N W | X | S W | X | S W |
| 1ST ROW | A+ | A- | A+ | B- | A+ | A- | A+ | A- | A+ | B- | A+ | A- | A+ | A- | A+ | B- | A+ | A- | A+ |
| 2ND ROW | A+ | A- | A+ | B- | A+ | A- | A+ | A- | A+ | B- | A+ | A- | A+ | A- | A+ | B- | A+ | A- | A+ |
| 3RD ROW | A+ | A- | A+ | B- | A+ | A- | A+ | A- | A+ | B- | A+ | A- | A+ | A- | A+ | B- | A+ | A- | A+ |
| 4TH ROW | A+ | A- | A+ | B- | B+ | B- | B+ | C- | C+ | C- | D+ | D- | E+ | E- | E+ | F- | F+ | G- | G+ |
| 5TH ROW | A+ | A- | A+ | B- | B+ | B- | B+ | C- | C+ | C- | D+ | ↓ | E- | ↓ | E+ | F- | F+ | G- | G+ |
| 6TH ROW | A+ | A- | A+ | B- | B+ | B- | B+ | C- | C+ | C- | D+ | ↓ | E- | ↓ | E+ | F- | F+ | G- | G+ |
| 7TH ROW | A+ | A- | A+ | B- | B+ | B- | B+ | C- | C+ | C- | D+ | ↓ | E- | ↓ | E+ | F- | ↓ | G+ | ↓ |
| 8TH ROW | A+ | A- | A+ | B- | B+ | B- | B+ | C- | C+ | ↓ | D- | ↓ | E+ | E- | E+ | F- | ↓ | G+ | ↓ |
| 9TH ROW | A+ | A- | ↓ | B+ | ↓ | B- | B+ | C- | C+ | ↓ | D- | ↓ | E+ | E- | ↓ | F+ | ↓ | G- | G+ |
| 10TH ROW | A+ | A- | ↓ | B+ | ↓ | B- | B+ | C- | C+ | ↓ | D- | ↓ | E+ | E- | ↓ | F+ | ↓ | G- | G+ |
| 11TH ROW | A+ | A- | ↓ | B+ | ↓ | B- | ↓ | C+ | ↓ | ↓ | D- | ↓ | E+ | E- | ↓ | F+ | ↓ | G- | G+ |
| 12TH ROW | A+ | A- | ↓ | B+ | ↓ | B- | ↓ | C+ | ↓ | ↓ | D- | ↓ | E+ | E- | ↓ | F+ | ↓ | G- | G+ |
| 13TH ROW | A+ | A- | ↓ | B+ | ↓ | B- | ↓ | C+ | ↓ | ↓ | D- | ↓ | E+ | E- | ↓ | F+ | ↓ | G- | ↓ |
| 14TH ROW | A+ | A- | ↓ | B+ | ↓ | B- | ↓ | C+ | ↓ | ↓ | D- | ↓ | E+ | E- | ↓ | F+ | ↓ | G- | ↓ |
| 15TH ROW | A+ | A- | ↓ | B+ | ↓ | B- | ↓ | C+ | ↓ | ↓ | D- | ↓ | E+ | E- | ↓ | F+ | ↓ | G- | ↓ |
| 16TH ROW | A+ | A- | A+ | B- | A+ | A- | A+ | A- | A+ | B- | A+ | A- | A+ | A- | A+ | B- | A+ | A- | A+ |
| 17TH ROW | A+ | A- | A+ | B- | A+ | A- | A+ | A- | A+ | B- | A+ | A- | A+ | A- | A+ | B- | A+ | A- | A+ |
| 18TH ROW | A+ | A- | A+ | B- | A+ | A- | A+ | A- | A+ | B- | A+ | A- | A+ | A- | A+ | B- | A+ | A- | A+ |

KNOWN REFRESHED RANGE

INHERENT WRITE POLARITY
ODD-NUMBERED FRAME : POSITIVE POLARITY
EVEN-NUMBERED FRAME: NEGATIVE POLARITY

FIG. 20

IMAGE DISPLAY METHOD, IMAGE DISPLAY DEVICE, AND ELECTRONIC EQUIPMENT

BACKGROUND OF THE INVENTION

1. Field of Invention

The present invention relates to an image display method, an image display device, and electronic equipment in which a reduction in the display quality can be reduced or prevented when data is read from a display memory to display an image.

2. Description of Related Art

Typically, bitmap display panels, such as organic EL (Electroluminescent) devices and liquid crystal devices, use a method in which reading addresses from a display memory are sequentially designated (read and scanned) in synchronization with vertical and horizontal scanning in order to form a display according to the read grayscale data. The addresses of the display memory (also sometimes called a "frame memory" or a "video memory") have a one-to-one correspondence with the pixels constituting the display device. Each of the addresses stores grayscale data to specify the gray level (density or intensity) of the corresponding pixel. Thus, each time a host control circuit, such as a CPU, refreshes the content stored in the display memory, the image displayed on the display panel is also updated accordingly.

If the host control circuit refreshes the content stored in the display memory during the reading and scanning operation, then, for one vertical scanning period (one frame) in which the content was refreshed, a mixture of the display based on the stored content that has not been refreshed and the display based on the stored content that has been refreshed is shown (tearing), thus possibly causing the display quality to be significantly reduced.

In order to reduce or prevent a reduction in the display quality, therefore, it is necessary that the host control circuit perform a procedure synchronous with the reading and scanning operation, such that an instruction to refresh the grayscale data during a period other than the reading and scanning period is given.

SUMMARY OF THE INVENTION

However, such a procedure would increase the load on the host control circuit, causing a problem in that the functionality of the host control circuit is reduced.

Two screens (two frames) can be used as a display memory. For one frame, the reading and scanning operation from a first portion (screen) of the display memory is performed while the writing operation to a second portion of the display memory is performed. For the next frame, the reading and scanning operation from the second portion of the display memory is performed while the writing operation to the first portion of the display memory is performed. This method can prevent a reduction in the display quality although double the capacity of the display memory is required, and therefore it is not suitable for use.

In order to address or overcome the foregoing problems, the present invention provides an image display method, an image display device, and electronic equipment in which a reduction in the display quality can be reduced or prevented without increasing the load on a host control circuit.

To this end, the present invention provides an image display method for specifying reading addresses from a display memory in an order synchronous with vertical scanning and horizontal scanning of a display panel, the display memory having addresses corresponding to individual pixels in the display panel, and having grayscale data stored therein, the grayscale data specifying the gray level of the pixel for each address, and for sequentially reading the grayscale data from the reading addresses to set the pixels of the display panel to the gray level specified by the grayscale data. The image display method includes: determining whether or not a specific refresh, which can cause a reduction in the display quality, occurred in the display memory during a reading and scanning period in which the reading addresses are specified; and if it is determined in the determining step that the specific refresh occurred, skipping the reading operation of the grayscale data at least from an address at which the specific refresh occurred during the reading and scanning period in which the specific refresh occurred, and maintaining a pixel corresponding to the skipped address at the gray level specified by the grayscale data read before the reading and scanning period.

The present invention enables grayscale data to be written to a display memory, regardless of scanning based on a reading address, thus reducing the load on a host control circuit to perform this writing operation. In addition, the reading operation from an address at which a specific refresh, which can cause a reduction in the display quality, occurred is skipped, and a pixel corresponding to this address is maintained at the gray level specified by the previously read grayscale data, thus reducing or preventing tearing of display image, resulting in no or substantially no reduction in the display quality.

In the image display method according to the present invention, in the determining step, when grayscale data was refreshed during the reading and scanning period, it is determined that the specific refresh occurred, regardless of the reading address at the time when the refresh occurred.

In the image display method according to the present invention, in the determining step, when grayscale data was refreshed during the reading and scanning period, it is determined whether or not all addresses in which the refresh occurred are included in a region specified as a reading address in the reading and scanning period in which the refresh occurred; a reading address when the refresh is completed is predicted, and it is determined whether or not all addresses in which the refresh occurred are included in a region after the predicted reading address; and, if both determinations are negative, it is determined that the specific refresh occurred.

In the image display method according to the present invention, in the skipping step, when it is determined in the determining step that the specific refresh occurred, the reading operation for rows subsequent to the row including the reading address at the time when the determination is made is skipped; and the pixels positioned after pixel rows corresponding to the addresses of the skipped rows are maintained.

The image display method according to the present invention further includes, following the skipping step: in the case where the write polarity for the same pixel is inverted at least every one vertical scanning period according to a polarity-indicator flag to indicate the write polarity, if it is determined in the determining step that the specific refresh occurred, writing, in a reading and scanning period subsequent to the reading and scanning period in which the specific refresh occurred, a pixel corresponding to the skipped address with a polarity opposite to the polarity in the reading and scanning period in which the specific refresh occurred, regardless of the polarity-indicator flag. When the opposite write polarity for the pixel corresponding to the skipped address is the same as the write polarity indicated by the indication during a reading and scanning period subsequent to the reading and scanning period in which the writing operation in the writing step was performed, the image display method further includes skipping the reading operation from the address corresponding to that pixel, and maintaining the pixel corresponding to the skipped address at the gray level written with the opposite polarity.

Furthermore, the present invention provides an image display device including: a display memory having addresses corresponding to individual pixels in a display panel, to store grayscale data to specify the gray level of the pixel for each address; a specifying device to specify reading addresses from the display memory in an order synchronous with vertical scanning and horizontal scanning of the display memory; and a reading device to sequentially read the grayscale data from the reading addresses. The pixels of the display panel are set to the gray level specified by the grayscale data. The image display device further includes: a determining device to determine whether or not a specific refresh, which can cause a reduction in the display quality, occurred in the display memory during a reading and scanning period in which the reading addresses are specified; and a first maintaining device to, if it is determined by the determining device that the specific refresh occurred, skip the reading operation of the grayscale data at least from an address at which the specific refresh occurred during the reading and scanning period in which the specific refresh occurred, and to maintain a pixel corresponding to the skipped address at the gray level specified by the grayscale data read before the reading and scanning period.

In the image display device according to the present invention, when grayscale data was refreshed during the reading and scanning period, the determining device determines that the specific refresh occurred, regardless of the reading address at the time when the refresh occurred.

In the image display device according to the present invention, when grayscale data was refreshed during the reading and scanning period, the determining device determines whether or not all addresses in which the refresh occurred are included in a region specified as a reading address in a reading and scanning period in which the refresh occurred. The determining device further predicts a reading address when the refresh is completed, and determines whether or not all addresses in which the refresh occurred are included in a region after the predicted reading address. If both determinations are negative, the determining device determines that the specific refresh occurred.

In the image display device according to the present invention, when the determining device determines that the specific refresh occurred, the first maintaining device skips the reading operation for rows subsequent to the row including the reading address at the time when the determination is made, and maintains the pixels positioned after pixel rows corresponding to the addresses of the skipped rows.

The image display device according to the present invention further includes, in the case where the write polarity for the same pixel is inverted at least every one vertical scanning period according to a polarity-indicator flag to indicate the write polarity, if the determining device determines that the specific refresh occurred, a writing device to write, in a reading and scanning period subsequent to the reading and scanning period in which the specific refresh occurred, a pixel corresponding to the skipped address with a polarity opposite to the polarity in the reading and scanning period in which the specific refresh occurred, regardless of the polarity-indicator flag. When the opposite write polarity for the pixel corresponding to the skipped address is the same as the write polarity indicated by the indication during a reading and scanning period subsequent to the reading and scanning period in which the writing operation was performed by the writing device, the image display device further includes a second maintaining device to skip the reading operation from the address corresponding to that pixel, and to maintain the pixel corresponding to the skipped address at the gray level written with the opposite polarity.

Furthermore, an electronic equipment according to the present invention includes the image display device according to the present invention.

BRIEF DESCRIPTION OF THE DRAWINGS

FIGS. 4(*a*) and 4(*b*) are timing charts illustrating the operation of the Y driver;

FIG. 9(*a*) is a chart illustrating the specific operation of image display in the related art, and FIG. 9(*b*) is a chart illustrating the specific operation of image display in the first embodiment;

FIG. 17 is a chart illustrating the specific operation of image display in the display device;

FIG. 18 is a chart illustrating the specific operation of image display in an application example of the display device;

FIG. 20 is a chart illustrating an application example of the image display method according the first or second embodiment.

DETAILED DESCRIPTION OF PREFERRED EMBODIMENTS

Embodiments of the present invention are now described with reference to the drawings.

First Embodiment

Figure 1:
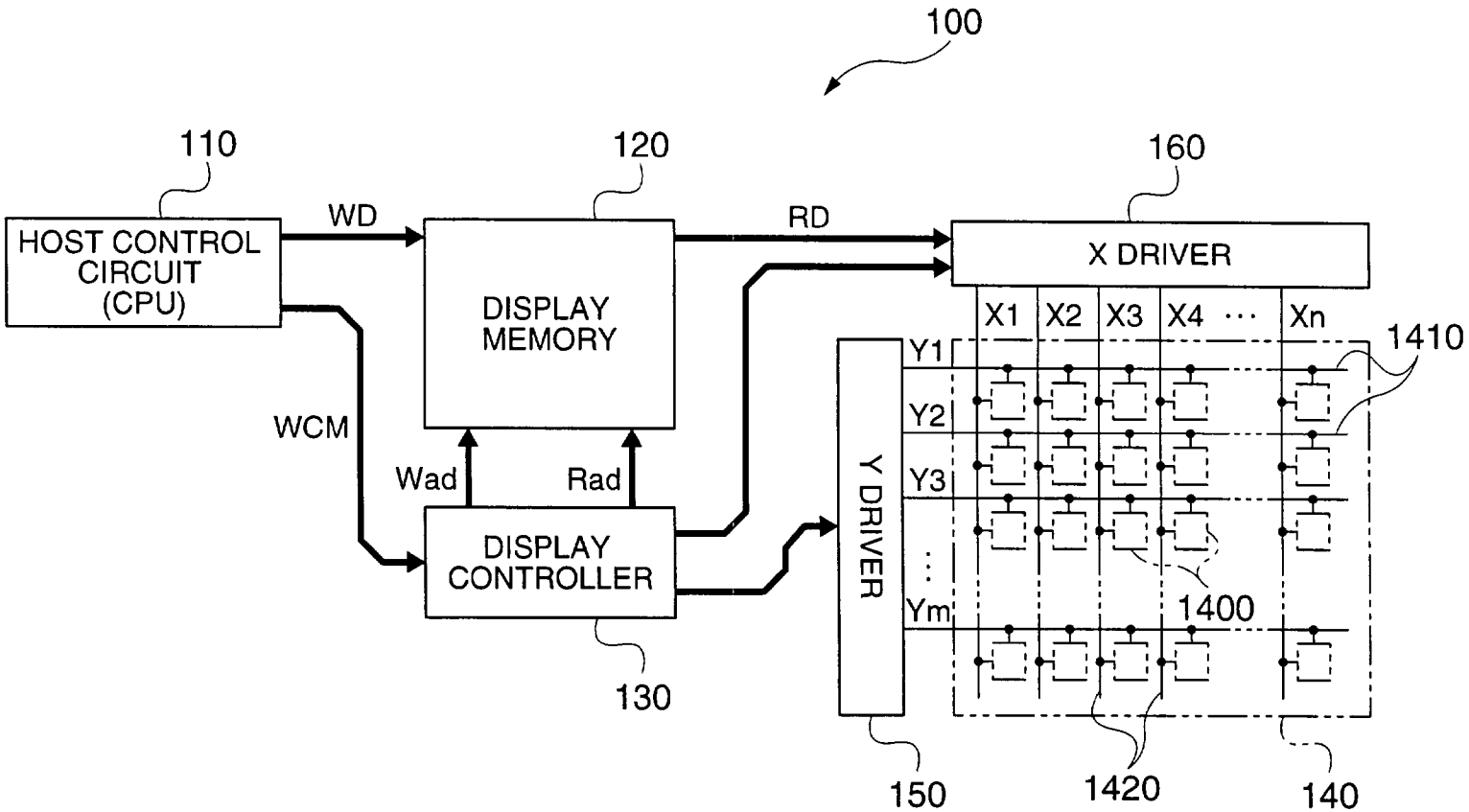
FIG. 1 is a schematic showing the configuration of a display device that uses an image display method according to a first embodiment of the present invention.

FIG. 1 is a schematic of the overall configuration of a display device that uses an image display method according to a first embodiment of the present invention.

As shown in FIG. 1, a display device 100 includes a host control circuit 110, a display memory 120, a display controller 130, a display panel 140, a Y driver 150, and an X driver 160.

Of these components, the host control circuit 110 is a control entity to perform various kinds of functions according to instructions from an operating switch, etc. (not shown). In particular, in the first embodiment, the host control circuit 110 generates data WD according to the content to be displayed, and issues an instruction WCM including information that the data WD has been generated and information about writing addresses for the data WD.

The display memory 120 is a memory dedicated to screen display, whose memory addresses have a one-to-one correspondence with the pixels of the display panel 140, and each address stores grayscale data RD to specify the gray level of the corresponding pixel. The storage capacity of the display memory 120 may be greater than the display capacity of the display panel 140, in which case part of the storage region in the display memory 120 has a one-to-one correspondence with the pixels of the display panel 140.

The display controller 130 causes a reading address Rad to read the grayscale data RD to sequentially progress according to the vertical and horizontal scanning, and generates various clock signals, etc. in synchronization with the progress. Upon receipt of the instruction WCM from the host control circuit 110, as described below, the display controller 130 causes the reading address Rad to stop progressing, and, when stopped, changes the timing at which the various clock signals are generated. The display controller 130 further interprets the received instruction WCM to generate a writing address Wad of the data WD.

In the first embodiment, the clock signals, etc. generated by the display controller 130 are a start pulse DY, a clock signal YCK, a start pulse DX, a clock signal XsCK, and a latch pulse LP.

The display panel 140 is an organic EL device having m scanning lines 1410 and n data lines 1420 which are arranged so as to intersect each other, and pixels 1400 at the intersections thereof. The Y driver 150 sequentially supplies scanning signals Y1, Y2, Y3, . . . , and Ym to the first to m-th rows of the scanning lines 1410, respectively. The X driver 160 generates data signals X1, X2, X3, . . . , and Xn according to the grayscale data RD read from the display memory 120, and simultaneously supplies them to the first to n-th columns of the data lines 1420, respectively.

<Pixel Configuration>

Figure 2:
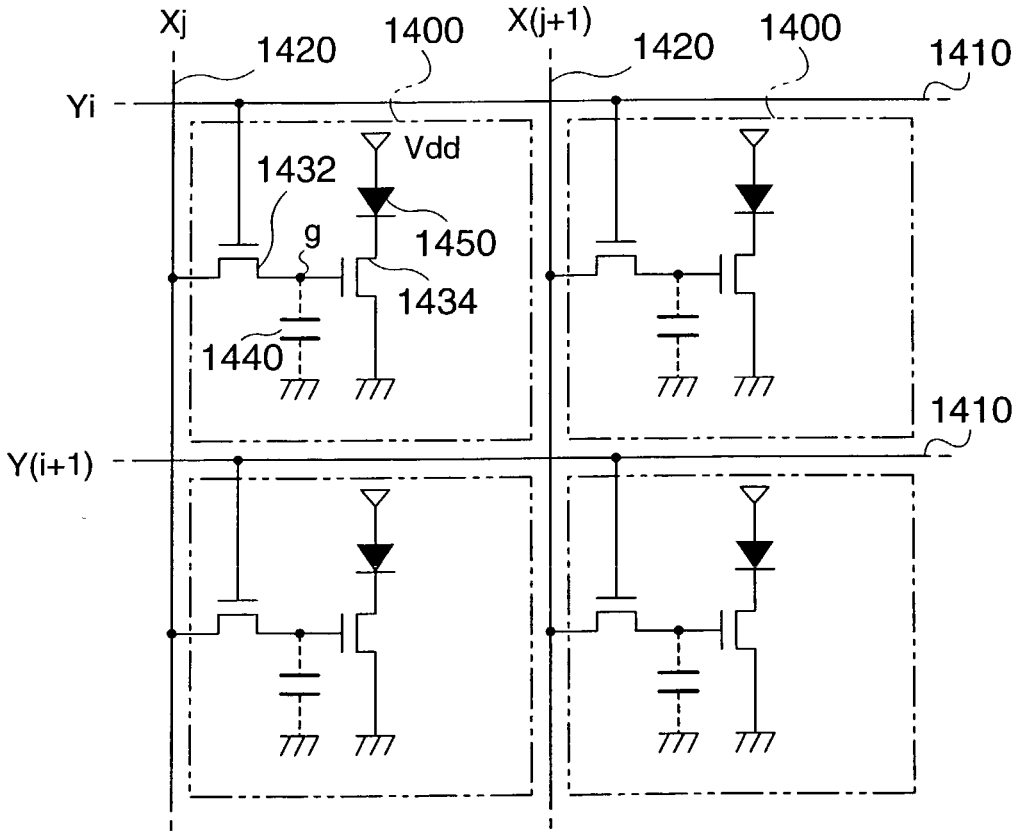
FIG. 2 is a circuit diagram showing the configuration of pixels in the display device.

The above-described pixels 1400 are now described in detail. FIG. 2 is a circuit diagram of the configuration of a total of four pixels arranged at the intersections of adjacent I-th and (i+1)-th rows of the scanning lines 1410 and adjacent j-th and j+1)-th columns of the data lines 1420, where i is used to generally describe the scanning lines 1410 and denotes an integer satisfying $1 \leqq i \leqq m$, and j is used to generally describe the data lines 1420 and denotes an integer satisfying $1 \leqq j \leqq n$.

As shown in FIG. 2, each of the pixels 1400 is provided with thin film transistors (hereinafter "TFTs") 1432 and 1434, and an EL element 1450.

For convenience, focusing on the pixel 1400 positioned at the intersection of the i-th row of the scanning lines 1410 and the j-th column of the data lines 1420, the TFT 1432 in that pixel 1400 is interposed between the j-th column of the data lines 1420 and the gate g of the TFT 1434. Since the gate of the TFT 1432 is connected to the i-th row of the scanning lines 1410, the TFT 1432 serves as a switch which is turned on when the scanning signal Yi goes high.

A parasitic capacitor 1440 is on the gate g of the TFT 1434 (the drain of the TFT 1432). Although a parasitic capacitance is used for the capacitor 1440 in the first embodiment, a capacitor provided between the gate g of the TFT 1434 and a feeder (for example, a ground line) having a constant potential may be used as the capacitor 1440.

The EL element 1450 is interposed in a forward-biased manner between a feeder of a supply voltage Vdd and the drain of the TFT 1434. More specifically, the anode of the EL element 1450 is connected to the feeder of the supply voltage Vdd while the cathode of the EL element 1450 is connected to the drain of the TFT 1434. The source of the TFT 1434 is grounded to a reference voltage Gnd. The EL element 1450 has an electroluminescent (EL) layer held between the anode thereof serving as a common electrode and the cathode thereof serving as a pixel electrode, and emits light with an intensity that depends upon the current. However, the details thereof are not directly related to the present invention and a description thereof is thus omitted. The EL element 1450 may be replaced with a light-emitting diode.

In this pixel 1400, the TFT 1432 is turned on when the scanning signal Yi goes high, so that the gate g of the TFT 1434 has a voltage of a data signal Xj that is applied to the j-th column of the data lines 1420 and a charge corresponding to this voltage is accumulated in the capacitor 1440. When the scanning signal Yi goes high, therefore, the TFT 1434 causes a current that depends upon the voltage of the data signal Xj to flow in the EL element 1450.

When the scanning signal Yi goes low, on the other hand, the TFT 1432 is turned off, although the capacitor 1440 allows the gate g of the TFT 1434 to be maintained at the voltage of the data signal Xj immediately before the TFT 1432 is turned off. Thus, even if the scanning signal Yi transitions from the high level to the low level, the TFT 1434 causes the maintained current that depends upon the voltage of the data signal Xj to remain flowing in the EL element 1450.

<Y Driver>

Figure 3:
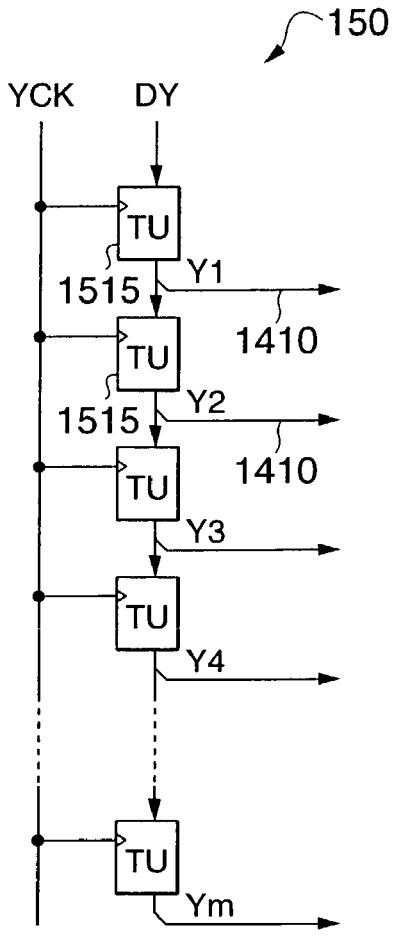
FIG. 3 is a schematic showing the configuration of a Y driver in the display device.

The above-described Y driver 150 is described in detail below. FIG. 3 is a schematic of the configuration of the Y driver 150.

As shown in FIG. 3, the Y driver 150 is a shift register, and is provided with a transfer unit (TU) 1515 at each row of the scanning lines 1410.

The clock signal YCK and the start pulse DY, which are generated by the display controller 130, are supplied to the Y driver 150.

Out of these signals, the former clock signal YCK usually has a frequency given by the reciprocal of one horizontal scanning period (1H); when a skipping process described below is performed, however, the clock signal YCK has a much higher frequency (by a factor of 1000, for example)

than usual, and continues to have this high frequency for at least m periods or more. The latter start pulse DY specifies the start of one frame (1F).

The transfer unit 1515 at the i-th row latches an input signal to the level immediately before the clock signal YCK rises, and supplies the latched signal as the scanning signal Yi to the i-th row of the scanning lines 1410, while supplying the latched signal as an input signal to the transfer unit 1515 at the next or (i+1)-th row. The input signal to the transfer unit 1515 in the first row is the start pulse DY.

In such a configuration, if the clock signal YCK is normal, as shown in FIG. 4(*a*), the signal DY supplied at the beginning of one frame (1F) is shifted in turn each time the clock signal YCK rises, and the shifted signal is output as scanning signals Y1, Y2, Y3, Y4, . . . , and Ym to the first, second, third, fourth, . . . , and m-th rows of the scanning lines 1410, respectively.

This allows the scanning signals Y1, Y2, Y3, Y4, . . . , and Ym to become high one after another for one horizontal scanning period (1H) from the rise time of the clock signal YCK after the signal DY goes high.

If the frequency of the clock signal YCK increases, however, for example, if the frequency of the clock signal YCK increases when the scanning signal Y3 has transitioned from the high level to the low level, then, from this timing, as shown in FIG. 4(*b*), the scanning signals Y4, Y5, . . . , and Ym become high only for an instant although the scanning signals Y1, Y2, and Y3 become high one after another for one horizontal scanning period (1H).

As described above, when the scanning signal Yi becomes high, the capacitors 1440 in the pixels 1400 at the i-th row are charged or discharged depending upon the voltages of the data signals X1, X2, X3, . . . , and Xn. However, if the scanning signal Yi is high for an extremely short period, the amount of accumulated charge does not substantially change. Therefore, there is substantially no change in the amount of charge accumulated in the capacitors 1440 if the scanning signal Yi is high only for an instant due to an increased frequency of the clock signal YCK, thus maintaining the intensity of the corresponding EL elements 1450.

<X Driver>

Figure 5:
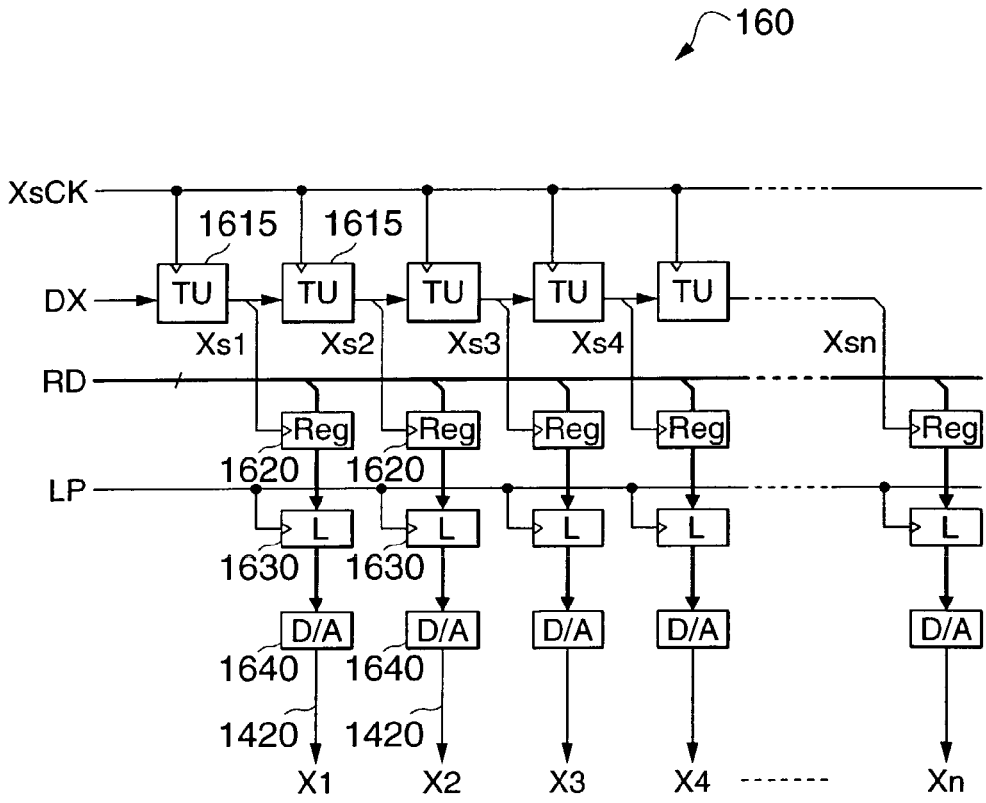
FIG. 5 is a schematic showing the configuration of an X driver in the display device.

The above-described X driver 160 is described in detail below. FIG. 5 is a schematic of the configuration of the X driver 160.

As shown in FIG. 5, the X driver 160 includes a transfer unit (TU) 1615, a register (Reg) 1620, a latch circuit (L) 1630, and a D/A converter 1640 at each column of the data lines 1420.

The clock signal XsCK, the start pulse DX, and the latch pulse LP, which are generated by the display controller 130, and the grayscale data RD read from the display memory 120 are supplied to the X driver 160.

Out of these signals, the clock signal XsCK is a signal to cause the transfer unit 1615 to transfer an input signal, and has the same period as the interval for which the reading address Rad progresses. The start pulse DX is output when reading of the grayscale data RD for one row starts. The latch pulse LP is output immediately after the last or n-th column of grayscale data in one row has been read, and specifies the start of one horizontal scanning period.

The transfer unit 1615 at the j-th column latches an input signal to the level immediately before the clock signal XsCK rises, and outputs the latched signal as a sampling control signal Xsj, while supplying the latched signal as an input signal to the transfer unit 1615 at the next or (j+1)-th column. The input signal to the transfer unit 1615 at the first column is the start pulse DX.

Then, the register (Reg) 1620 at the j-th column samples and holds the grayscale data RD supplied via a data bus at the rise time of the sampling control signal Xsj output from the transfer unit 1615 at the j-th column.

The latch circuit (L) 1630 at the j-th column then latches and outputs the grayscale data RD held by the register 1620 at the same j-th column at the rise time of the latch pulse LP.

The D/A converter 1640 at the j-th column then converts the grayscale data RD latched by the latch circuit 1630 at the same j-th column into an analog voltage, and outputs the analog voltage as a data signal Xj to the j-th column of the data lines 1420.

Figure 6:
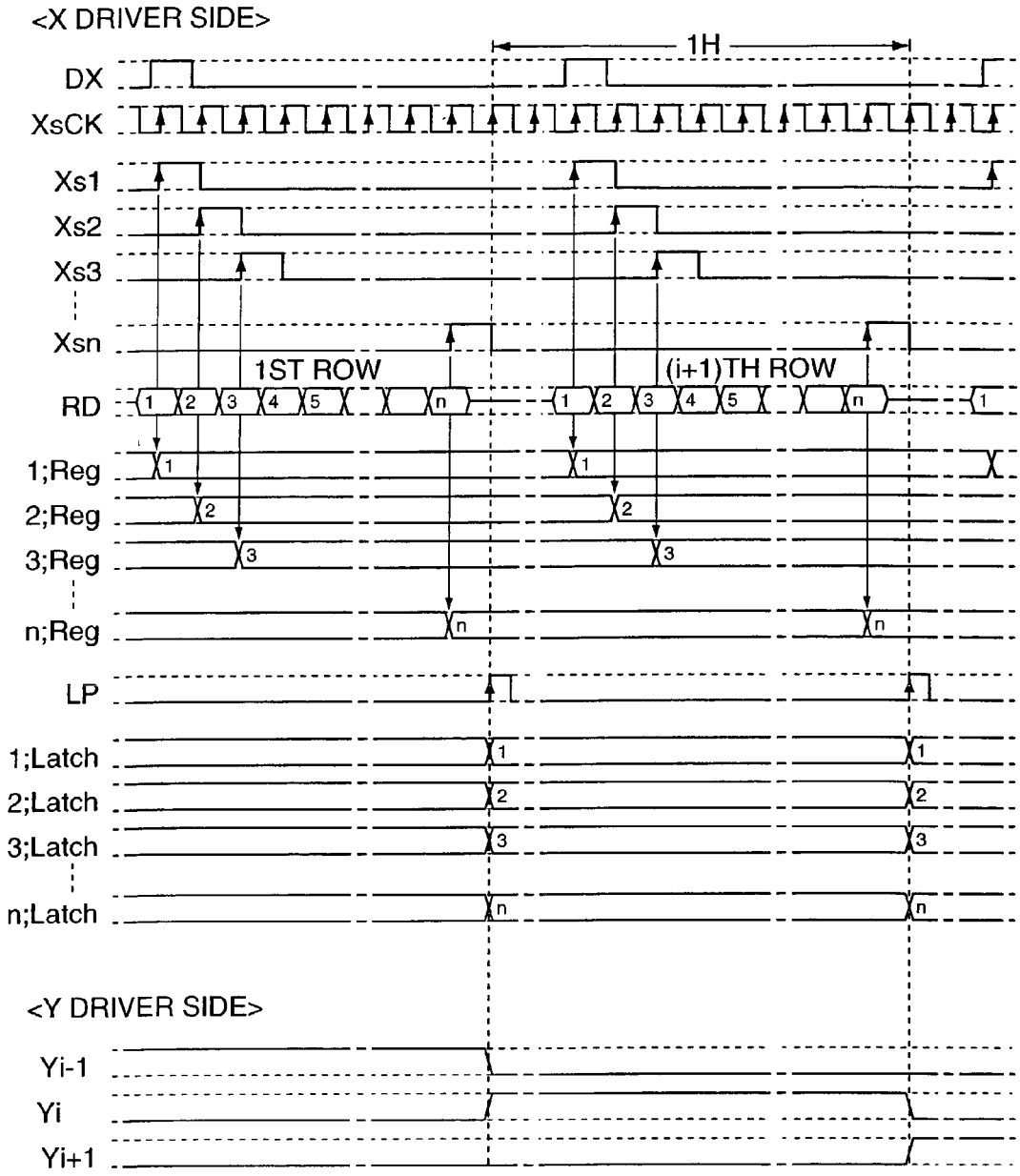
FIG. 6 is a timing chart illustrating the operation of the X driver.

FIG. 6 is a timing chart illustrating the operation of the X driver 160. As shown in FIG. 6, when the start pulse DX goes high prior to the time at which the latch pulse LP is output and the scanning signal Yi transitions to the high level, the grayscale data RD for the pixels on the i-th row in the first, second, third, . . . , and n-th columns are sequentially read and supplied from the display memory 120.

Out of these data, when a sampling control signal Xs1 becomes high when the grayscale data RD for the pixel between the i-th row and the first column is supplied, this grayscale data is sampled by the register 1620 at the first column (indicated by "1:Reg" in FIG. 6).

Then, when a sampling control signal Xs2 becomes high when the grayscale data RD for the pixel between the i-th row and the second column is supplied, this grayscale data is sampled by the register 1620 at the second column (indicated by "2:Reg" in FIG. 6). Likewise, the grayscale data RD for the pixels at the third, fourth, . . . , and n-th columns are sampled by the registers 1620 at the third, fourth, . . . , and n-th columns, respectively.

When the latch pulse LP is output, the grayscale data RD sampled by the registers 1620 at the respective columns are simultaneously latched in the corresponding latch circuits 1630 in those columns.

The grayscale data RD latched at the first, second, third, . . . , and n-th columns are converted by the D/A converters 1640 at the first, second, third, . . . , and n-th columns, respectively, and are simultaneously output as data signals X1, X2, X3, . . . , and Xn, respectively.

In response to simultaneously outputting the data signals for one row, that is, in synchronization with outputting of the latch pulse LP, the scanning signal Yi goes low, and the i-th row of the scanning lines 1410 is selected.

Although the outputting operation of data signals corresponding to the pixels positioned at the i-th row has been described herein, in fact, such an outputting operation is sequentially performed for the first, second, third, . . . , and m-th rows of the scanning lines 1410.

<Display Controller>

Figure 7:
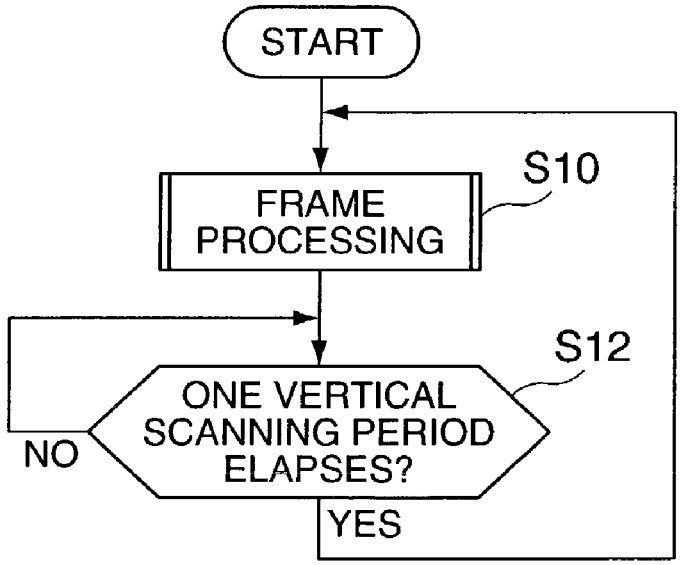
FIG. 7 is a flowchart showing a main routine of a display controller in the display device.

The processing performed by the display controller 130 is now described in detail. FIG. 7 is a flowchart showing the processing of a main routine in the display controller 130.

As shown in FIG. 7, immediately after being powered on or reset, the display controller 130 performs frame processing (step S10).

After the frame processing, the display controller 130 determines whether or not a period corresponding to one vertical scanning period (one frame) has elapsed since the frame processing started (step S12).

If a negative determination is made in step S12, the routine returns to step S12, and the display controller 130 waits. On the other hand, if an affirmative determination is made, the display controller 130 performs the frame processing again. In other words, the frame processing in step S10 is performed every other frame.

The frame processing is now described in detail. The term "frame processing" means processing to read data from the display memory 120, excluding processing to write data upon receipt of the instruction WCM from the host control circuit 110.

For the write processing, upon receiving the instruction WCM from the host control circuit 110, the display controller 130 writes the data WD to the display memory 120 according to the writing address contained in the instruction WCM, independently of the reading and scanning operation. This enables the host control circuit 110 to transfer the data WD or to issue the instruction WCM without taking the designation (reading and scanning operation) of the reading address by the display controller 130 into account, thereby reducing the load on the host control circuit 110. It is assumed in the first embodiment that data is not refreshed for two consecutive frames.

Figure 8:
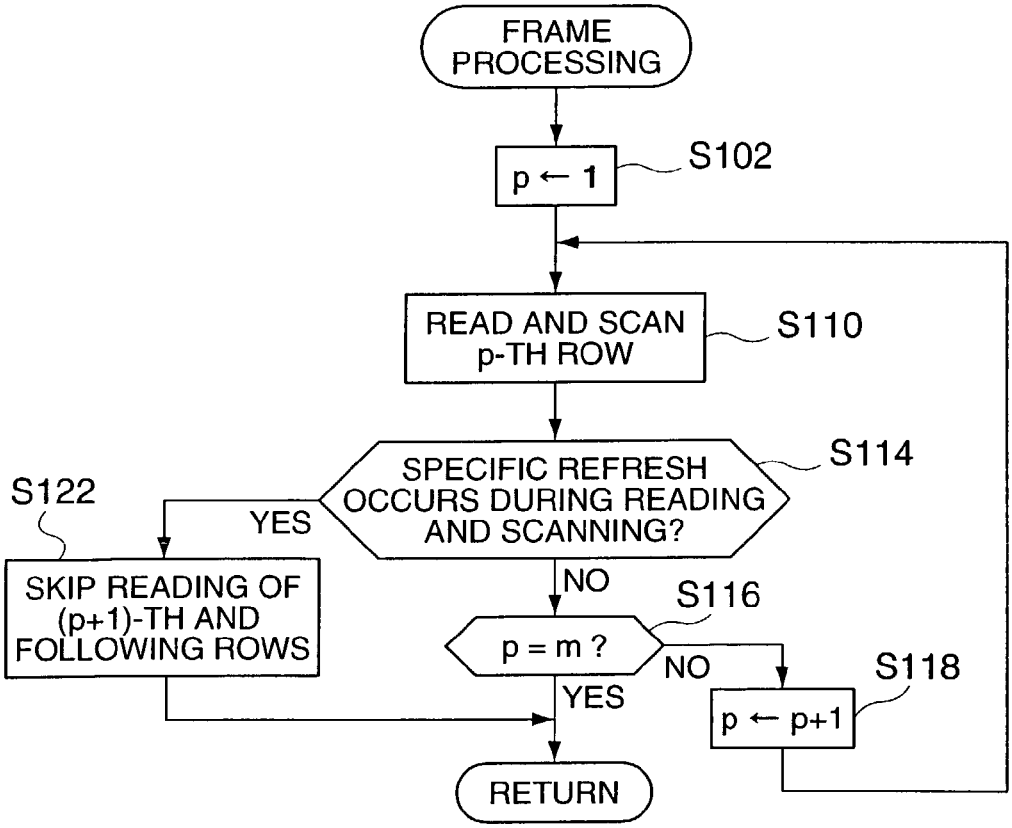
FIG. 8 is a flowchart showing frame processing in the main routine.

FIG. 8 is a flowchart showing the details of the frame processing.

First, the display controller 130 sets a variable p to "1" (step S102). The variable p is set to any integer ranging from "1" to "m", that is the number of scanning lines 1410, indicating a pixel row to be read and scanned. If the variable p is set to "1" in step S102, the first pixel row is to be read and scanned first.

Then, the display controller 130 performs the reading and scanning operation for the pixel row specified by the variable p (step S110). More specifically, the display controller 130 causes the reading address Rad to progress in synchronization with the clock signal XsCK so as to sequentially designate the addresses in which the grayscale data of the pixels positioned on the p-th row in the first to n-th columns are stored (step S110). This progress allows the grayscale data RD for one row of pixels on the p-th row, from the first to n-th columns, to be sequentially read from the display memory 120 and then supplied to the X driver 160.

Then, the display controller 130 determines whether or not a specific refresh has occurred during the reading and scanning operation in step S110 (step S114).

As used herein, the term "specific refresh" means a refresh operation which might possibly cause the display quality to be reduced due to display tearing. In the first embodiment, particularly, the term "specific refresh" simply means a refresh operation of grayscale data in the display memory 120. Since refreshing of the grayscale data necessarily occurs upon receipt of the instruction WCM from the host control circuit 110, the occurrence of the specific refresh is analogous to reception of the instruction WCM.

If such a specific refresh does not occur (the instruction WCM is not received), the display controller 130 determines whether or not the current value of the variable p is equal to the number of scanning lines 1410, that is, m, in other words, the display controller 130 determines whether or not the last or m-th row is to be read and scanned (step S116).

If a negative determination is made in step S116, the display controller 130 increments the variable p by "1" (step S118) so that the next pixel row is read and scanned, and the routine returns to step S110. Thus, again in step S110, the reading and scanning operation is performed for the next row.

Accordingly, as long as a negative determination is made in step S114, the reading and scanning operation in step S110 is performed when the variable p is set to a number ranging from "1" to "m", i.e., for each row of the first to m-th rows.

If an affirmative determination is made in step S116, which means that the reading and scanning operation up to the last or m-th row in the present frame is completed, the display controller 130 terminates the present frame processing, and waits for the start of the next frame processing (step S12).

If it is determined in step S114 that the specific refresh has occurred, the display controller 130 temporarily increases the frequency of the clock signal YCK after the scanning signal Yp supplied to the p-th row of the scanning lines 1410 transitions from the high level to the low level (step S122). Then, the display controller 130 terminates the present frame processing, and waits for the next frame.

Specifically, if the specific refresh occurs during the reading and scanning operation for the p-th row, the present frame processing terminates without performing the reading and scanning operation for the (p+1)-th row. Therefore, the grayscale data for the pixels from the (p+1)-th row to the last or m-th row are not read from the display memory 120.

Furthermore, since the scanning signals supplied to the (p+1)-th row to the last or m-th row of the scanning lines 1410 become high only for an instant, the intensities of the EL elements 1450 from the (p+1)-th row to the last or m-th row are maintained from the previous frame. Thus, the content displayed by the pixels 1400 from the first row to the last or m-th row does not change even if the display memory 120 is refreshed during the reading and scanning period for the first row to the m-th row.

<Comparison with the Comparative Example>

Figure 10:
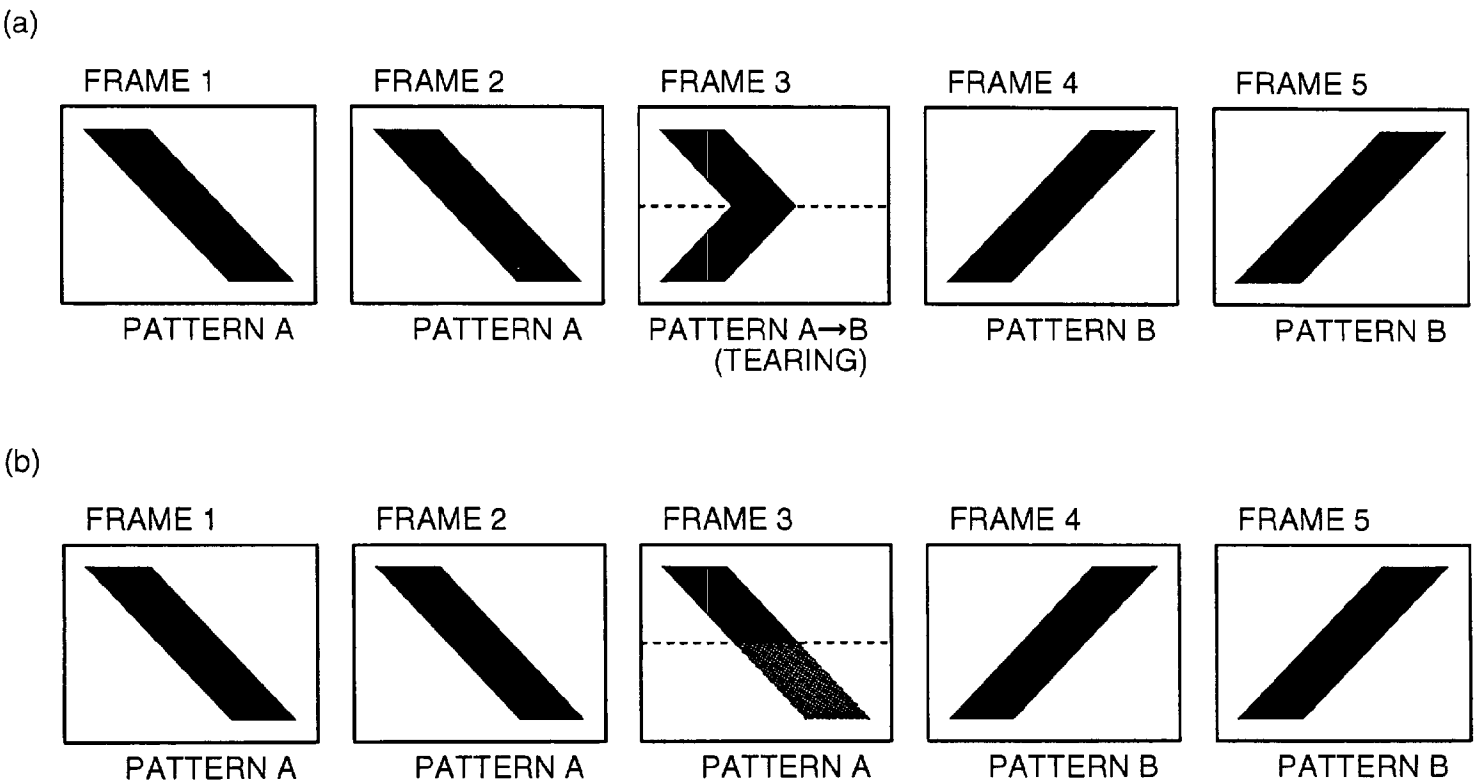
FIG. 10(*a*) is a schematic describing the display method in the related art, and FIG. 10(*b*) is a schematic describing the display method in the first embodiment.

A comparative example for comparison with the first embodiment is described below. FIG. 9(*a*) is a chart of the comparative example, showing, on a frame basis, how the grayscale data for each row is read from the display memory 120. FIG. 10(*a*) is a schematic showing the displayed content of the display panel 140, on a frame basis, when the grayscale data is read in the manner shown in FIG. 9(*a*). In FIG. 9(*a*), for simplification of illustration, 18 rows are displayed on the display panel 140. In FIGS. 9(*a*) and 9(*b*), the alphabet letters denote displayed patterns.

A host control circuit in the comparative example instructs data writing to a display memory independently of (in an asynchronous manner with) the reading and scanning operation from the display memory, and the content of the display memory may be updated during the reading and scanning operation.

For example, in FIG. 9(*a*), the grayscale data of pattern A is read from the display memory in frames 1 and 2, while the display memory 120 is refreshed with the grayscale data of pattern B in frame 3 when the grayscale data for the eighth row are being read and scanned.

Therefore, as shown in FIG. 10(*a*), the display panel 140 correctly presents the pattern A (in FIG. 10(*a*), a black parallelogram that is oblique to the left) for all rows in frames 1 and 2 (strictly speaking, after the reading and scanning operation is completed and after all of the scanning lines 1410 have been selected in the display panel 140). In frame 3, however, the display panel 140 presents the pattern A for the first to eighth rows, and the pattern B (in the figure, a black parallelogram that is oblique to the right) for the ninth and following rows. This results in different patterns (display tearing) presented on upper and lower portions of the screen, thereby significantly reducing the display quality.

In frame 4, as shown in FIG. 9(*a*), the display memory 120 is not refreshed during the reading and scanning period, and the display panel 140 correctly presents the pattern B for all rows in the manner shown in FIG. 10(*a*).

Although the displayed content of the display panel 140 in frame 6 and the following frames is not illustrated in FIG. 10(*a*), the refresh operation during the reading and scanning period occurs, as shown in FIG. 9(*a*), when the grayscale data for the tenth row is being read and scanned in frame 7 and when the grayscale data for the seventh row is being read and scanned in frame 10. Therefore, display tearing also occurs in frames 7 and 10.

In the first embodiment, on the other hand, if the grayscale data is refreshed during the reading and scanning period of the grayscale data for the eighth row in frame 3, the reading and scanning operation of the grayscale data for the ninth and following rows is skipped, as indicated by arrows in FIG. 9(*b*).

This operation is described in conjunction with the frame processing in FIG. 8. In the frame processing for frame 3, the reading and scanning operation in step S110 is performed each time the variable p is set to a value ranging from "1" to "8". Since a positive determination is made in step S114 when the variable p is "8", the routine is branched to step S122. As a result, the reading and scanning operation for the ninth and following rows of grayscale data is skipped.

As shown in FIG. 10(*b*), therefore, the display panel 140 presents the pattern A for the pixels at the first to eighth rows according to the grayscale data read in the frame processing in frame 3. For the pixels in the ninth and following rows, however, the pattern is presented according to the grayscale data read in the previous frame processing (i.e., the frame processing in frame 2), resulting in presentation of the pattern A.

Although not shown in FIG. 10(*b*), the same procedure is performed for frames 7 and 10 in FIG. 9(*b*).

According to the first embodiment, therefore, even if a refresh occurs during the reading and scanning period, display tearing, which occurs in the comparative example, does not occur, thus making it possible to reduce or prevent a reduction in the display quality.

Since the lower portion of the screen is not refreshed in two frames, i.e., frames 2 and 3, the charge accumulated in the capacitors 1440 in the pixels corresponding to the lower portion (in the ninth and following rows) leaks more than in the capacitors 1440 in the pixels corresponding to the upper portion (in the first to eighth rows) which are refreshed every frame. As a result, as shown in FIG. 10(*b*), the intensity is slightly reduced.

Second Embodiment

The above-described first embodiment provides a display method which reduces or prevents display tearing in a display device using elements employing the DC-driving principle, such as the EL elements 1450. The present invention is not limited thereto, and may also be applied to a display device using elements employing the AC-driving principle, such as liquid crystal elements.

If the reading and scanning operation is skipped because of the occurrence of the specific refresh, pixels corresponding to the skipped addresses are not refreshed. Thus, a voltage which has a polarity specified in the next frame and which depends upon the grayscale data read during the reading and scanning operation in the present frame is written to those pixels.

If the write polarity with respect to the liquid crystal element is reversed every frame for AC driving, however, data signals with the same polarity are continuously written to the pixels corresponding to the skipped addresses, because, after being written with a first polarity, the data is not written with a second polarity due to the occurrence of skipping but is written with the first polarity again.

This introduces a failure of the AC-driving principle. Therefore, the first embodiment cannot be simply applied to a display device using a liquid crystal element.

In a second embodiment of the present invention, therefore, as described below, when the reading and scanning operation is skipped, pixels corresponding to the skipped addresses are prevented from being written with the same polarity.

A display device that uses a display method according to the second embodiment is different from a display device that uses the display method according to the first embodiment in view of the following three points: a different pixel configuration (difference 1), different configuration of the X driver 160 (difference 2), and a different frame processing (read processing) in the display controller 130 (difference 3). These three points are described below in turn. Other points are the same as those in the first embodiment, and a description thereof is omitted.

<Pixel>

Figure 11:
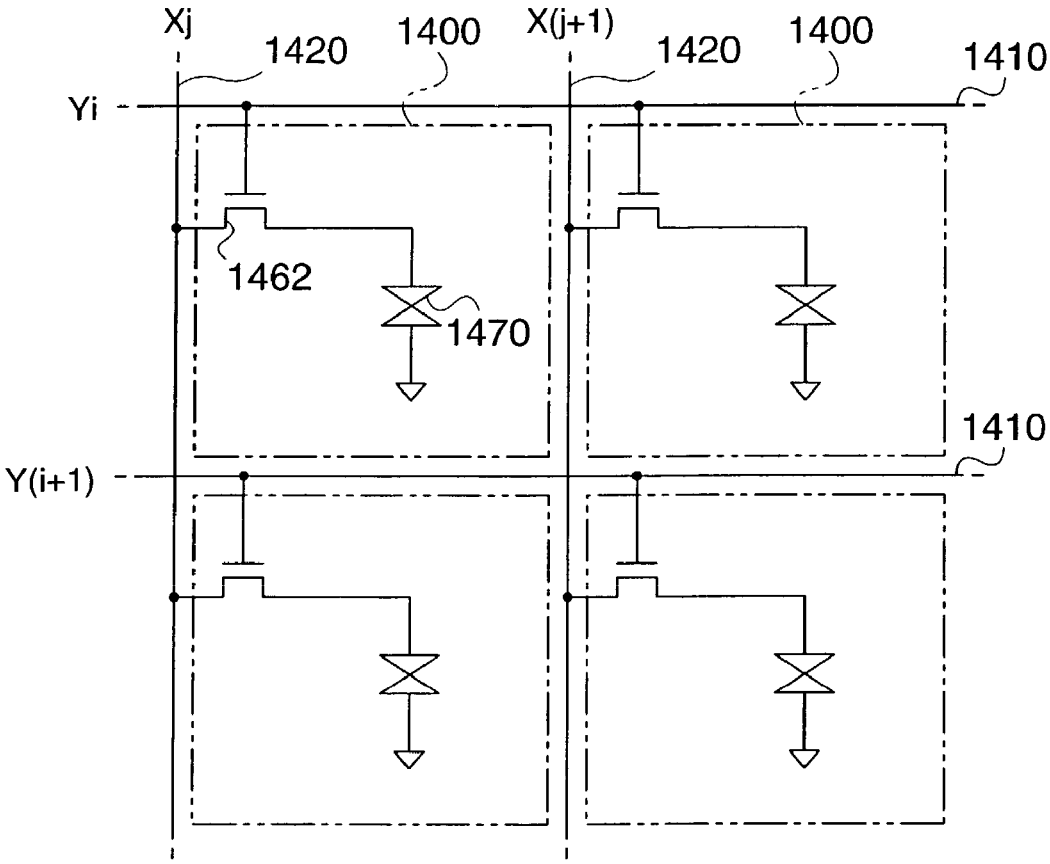
FIG. 11 is a circuit diagram showing the configuration of pixels in a display device that uses an image display method according to a second embodiment of the present invention.

FIG. 11 is a circuit diagram of pixels in a display device that uses the display method according to the second embodiment.

As depicted in FIG. 11, each of the pixels 1400 includes a TFT 1462, and a liquid crystal element 1470. Focusing on the pixel 1400 positioned at the intersection of the i-th row of the scanning lines 1410 and the j-th column of the data lines 1420, the TFT 1462 in that pixel 1400 is interposed between the j-th column of the data lines 1420 and one end of the liquid crystal element 1470. The gate of the TFT 1462 is connected to the i-th row of the scanning lines 1410. Thus, the TFT 1462 serves as a switch which is turned on when the scanning signal Yi goes high.

The liquid crystal element 1470 is formed of a rectangular pixel electrode at one end thereof, a counter electrode at the other end thereof, and a liquid crystal sandwiched between the electrodes, thereby forming a capacitor, such that the alignment of liquid crystal particles varies depending upon the amount of charge accumulated in the capacitor.

The counter electrode is common in the pixels 1400, whose potential is constant over time. In the second embodiment, therefore, the term "write with the positive polarity" means writing of voltage with a higher potential than the potential of the counter electrode, while the term "write with the negative polarity" means writing of voltage with a lower potential than the potential of the counter electrode.

The drain D (pixel electrode) of the TFT 1462 may sometimes be further provided with a storage capacitor in order to reduce leakage of the charge accumulated in the liquid crystal element.

In the configuration shown in FIG. 11, when the scanning signal Yi becomes high, the TFTs 1462 are turned on in the pixels 1400 in the I-th row, and, at the intersection of the i-th row and the j-th column, for example, the potential of the pixel electrode at one end of the liquid crystal element 1470 becomes a voltage of the data signal Xj. Then, a charge corresponding to the voltage of the data signal Xj is accumulated in that liquid crystal element. After the charge is accumulated, when the scanning signal Yi goes low to turn the TFT 1462 off, the charge accumulated in the liquid crystal element 1470 is maintained.

Since the alignment of the liquid crystal particles varies according to the amount of charge accumulated in the liquid crystal element 1470, the amount of user-visible light which passes through the liquid crystal element 1470 and which outgoes from a polarizer (not shown) also varies according to the amount of accumulated charge.

Therefore, even if a scanning signal transitions from the high level to the low level, the pixel 1400 maintains the state specified by the data signal Xj that is high.

Other than the configuration shown in FIG. 11, the pixel 1400 using a liquid crystal element may be implemented by an configuration in which a two-terminal non-linear element (such as a thin film diode) having a bi-directional diode characteristic and the liquid crystal element 1470 are interposed in series between the scanning line 1410 and the data line 1420. The pixel 1400 may also be implemented by a configuration of the passive matrix type in which a liquid crystal element is driven without using a non-linear element such as a three-terminal non-linear element including a TFT or a two-terminal non-linear element having a bi-directional diode characteristic, and, more specifically, may be implemented by a configuration of the passive matrix type in which the scanning line 1410 is used as one end of the liquid crystal element 1470 and the data line 1420 is used as the other end of the liquid crystal element 1470. Although, by way of example, the voltage modulation method using a D/A converting circuit is used herein as a method for grayscale display, of course, the pulse-width modulation method or any other method may also be used.

<X Driver>

Figure 12:
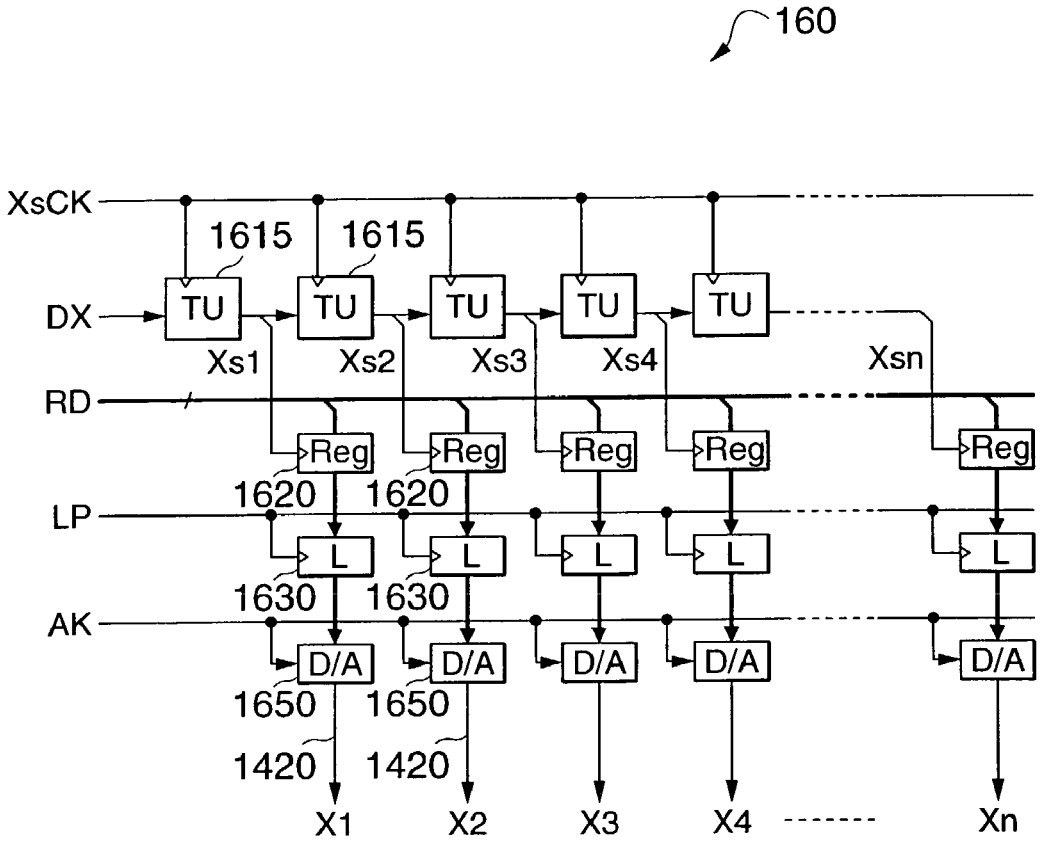
FIG. 12 is a schematic showing the configuration of an X driver in the display device.

FIG. 12 is a schematic of the configuration of an X driver 160 according to the second embodiment. The configuration shown in FIG. 12 is different from the configuration shown in FIG. 5 in that the D/A converter 1640 at each column is replaced with a D/A converter 1650 and that a signal AK is supplied to the D/A converters 1650.

The signal AK is a signal generated by the display controller 130 to instruct the D/A converters 1650 on the polarity of the output signal. More specifically, the signal AK indicates the positive polarity when the signal AK is low, and the negative polarity when it is high.

The D/A converter 1650 at the j-th column converts the grayscale data latched when the latch pulse LP rises into an analog signal of the polarity indicated by the signal AK. The D/A converter 1650 then outputs the analog signal as a data signal Xj to the j-th column of the data lines 1420.

<Display Controller>

Figure 13:
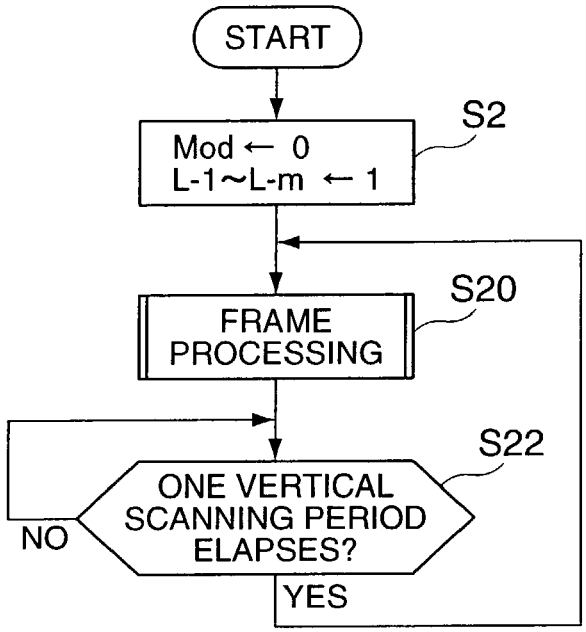
FIG. 13 is a flowchart showing a main routine of a display controller in the display device.

The processing performed by a display controller 130 according to the second embodiment is described in detail below. FIG. 13 is a flowchart showing the processing of a main routine in the display controller 130.

As shown in FIG. 13, immediately after being powered on or reset, the display controller 130 performs initialization processing (step S2). More specifically, the display controller 130 resets a register Mod to set a value to specify the operation mode into zero, and sets registers L-1, L-2, L-3, . . . , and L-m provided in the respective rows to "1".

It is assumed herein that values of "0", "1", "2", and "3" which are set for the register Mod indicate that the operation mode is a normal (N) mode, a write (W) mode, an exclusive (X) mode, and a skip (S) mode, respectively. Thus, the initialization processing in step S2 causes the operation mode to be set to the normal (N) mode.

The registers L-1, L-2, L-3, . . . , and L-m indicate the write polarity with respect to the pixels in the first, second, third, . . . , and m-th rows in the previous frame, respectively. In the second embodiment, value "0" indicates the positive polarity, and value "1" indicates the negative polarity. Since there is no frame before the first frame, it is assumed that the initialization processing in step S2 causes the write with the negative polarity to the rows in the previous frame that is not present.

After the initialization processing, the display controller 130 performs frame processing (step S20). Then, after the frame processing, the display controller 130 determines whether or not a period corresponding to one vertical scanning period (one frame) has elapsed since the frame processing started (step S22).

If a negative determination is made in step S22, the routine returns to step S22, and the display controller 130 waits. On the other hand, if an affirmative determination is made, the display controller 130 performs the frame processing again. In other words, the frame processing in step S20 is performed every other frame, as in the first embodiment.

Figure 14:
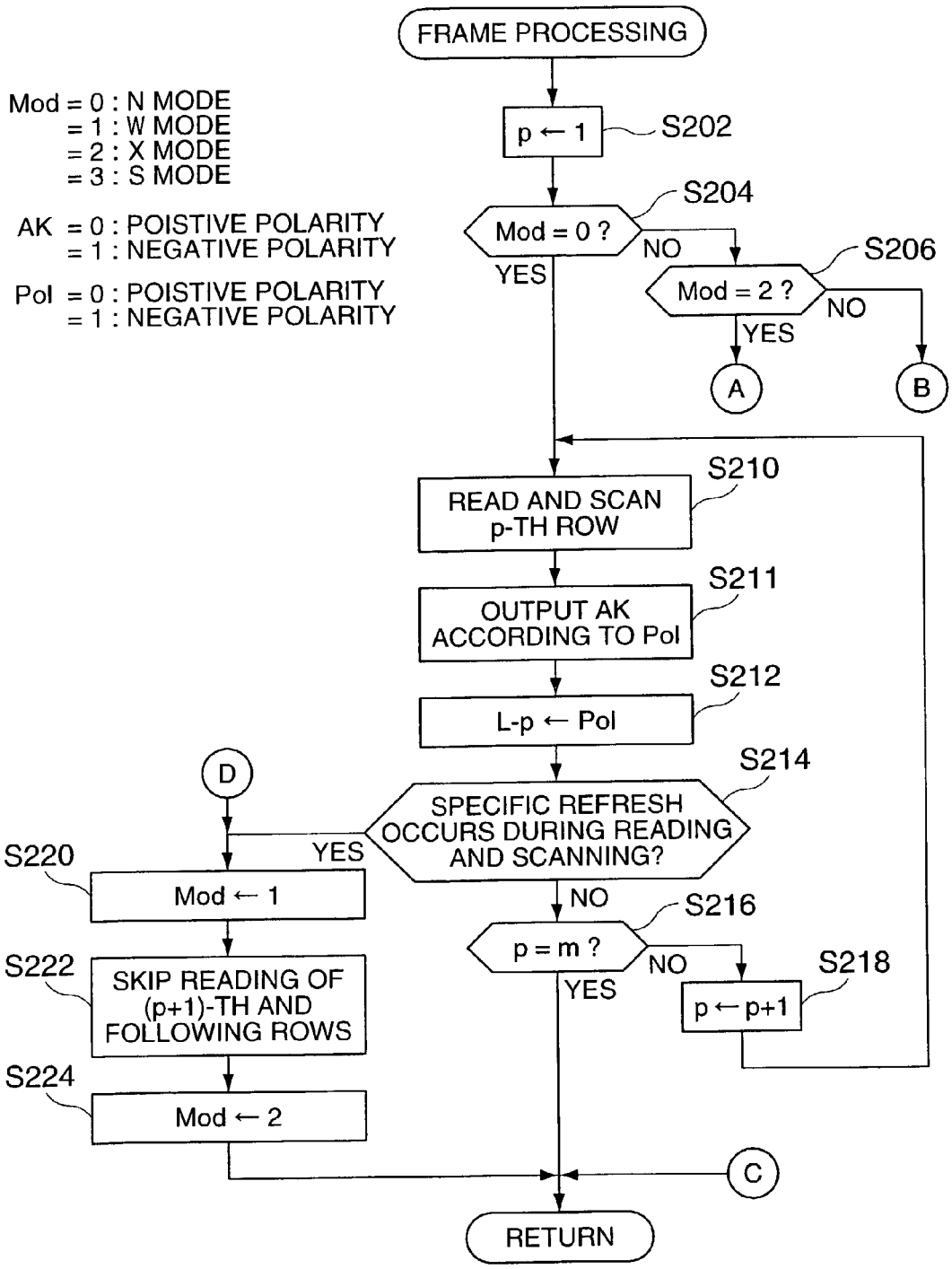
FIG. 14 is a flowchart showing frame processing in the main routine.
Figure 15:
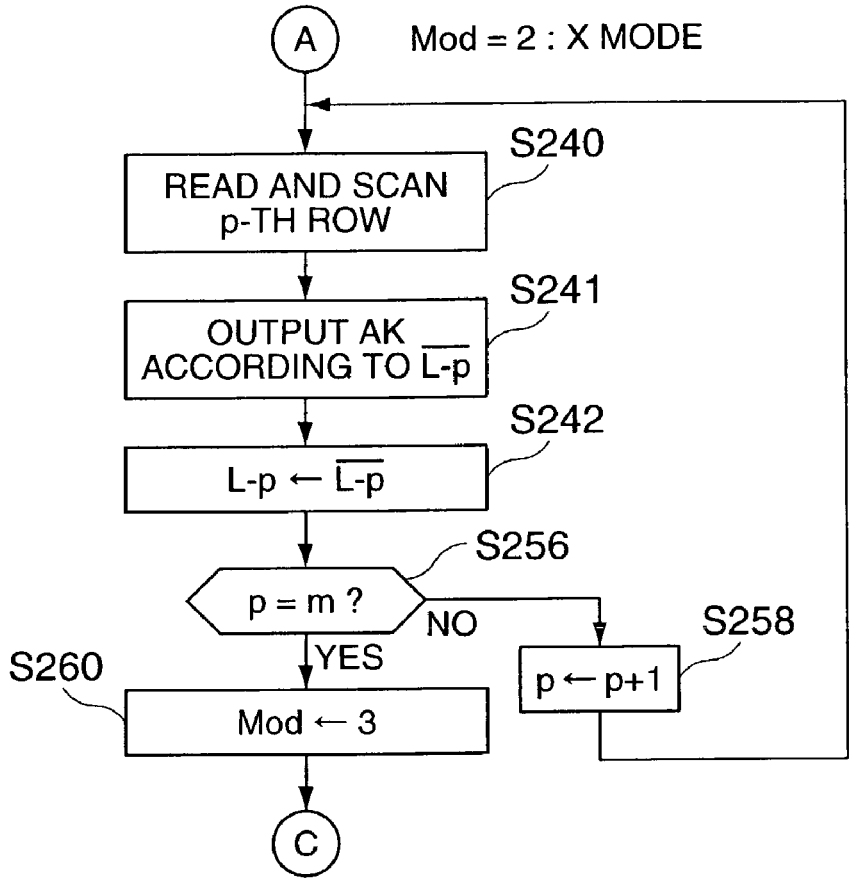
FIG. 15 is a flowchart showing the frame processing in the main routine.
Figure 16:
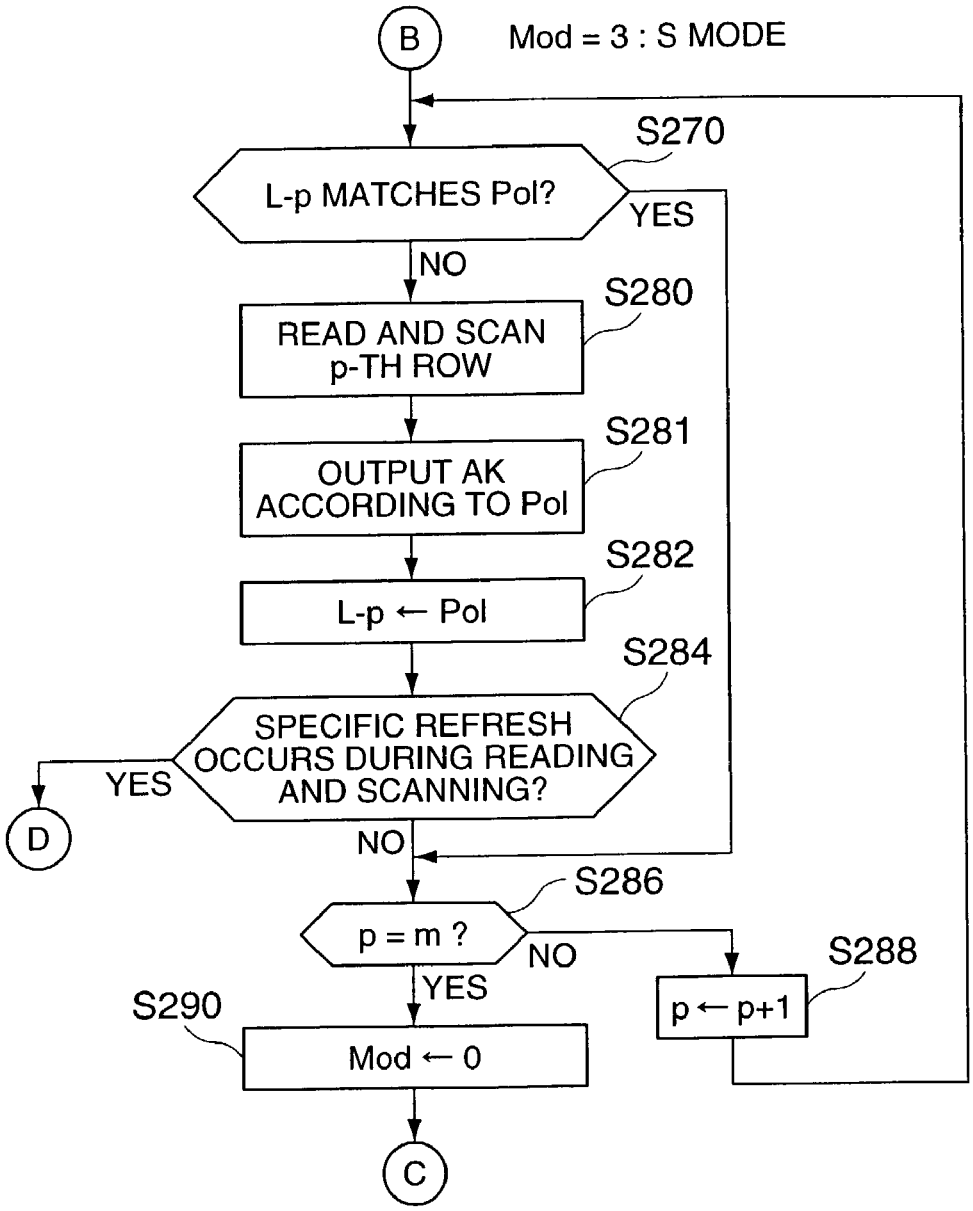
FIG. 16 is a flowchart showing the frame processing in the main routine.

The frame processing is now described in detail. FIGS. 14, 15, and 16 are flowcharts showing in detail the frame processing in the second embodiment.

First, at the beginning of the frame processing, the display controller 130 sets a variable p for specifying a pixel row to be read and scanned to "1" (step S202).

Then, the display controller 130 determines whether or not the value of the variable Mod is "0", that is, whether or not the operation mode is the normal (N) mode (step S204).

If an affirmative determination is made in step S204, the display controller 130 performs the reading and scanning operation for a pixel row specified by the variable p (step S210), as in step S110 in the first embodiment. This scanning operation allows the grayscale data for one row of pixels on the p-th row, from the first to n-th columns, to be sequentially read from the display memory 120 and then supplied to the X driver 160.

After the grayscale data in the p-th row and the n-th column has been read, the display controller 130 outputs the signal AK at the level of a write polarity indicated by a polarity-indicator flag Pol (step S211) before outputting the latch pulse LP.

The polarity-indicator flag Pol, as used herein, indicates the polarity with which the grayscale data read in the frame processing is written to the pixel 1400. More specifically, in the second embodiment, the polarity-indicator flag Pol indicates "0" for an odd-numbered frame, instructing the write with the positive polarity, and indicates "1" for an even-numbered frame, instructing the write with the negative polarity.

As previously described, in the X driver 160, the latch circuits 1630 latch the read grayscale data for one row before the D/A converters 1650 convert the latched data into data signals which are then supplied to the data lines 1420. If, in step S211, the signal AK is set to the logic level indicated by the polarity-indicator flag Pol after the grayscale data in the p-th row and the last or n-th column has been read and before the latch pulse LP is output, the data signals converted by the D/A converters 1650 are actually written to the pixels 1400 in the p-th row with a polarity indicated by the polarity-indicator flag Pol.

In order to record the write to the pixels 1400 in the p-th row with a polarity indicated by the polarity-indicator flag Pol in the present frame processing, the display controller 130 sets the current value of the polarity-indicator flag Pol for the register L-p in the p-th row (step S212).

Then, the display controller 130 determines whether or not a specific refresh has occurred during the reading and scanning operation in step S211 (step S214). As used herein, the term "specific refresh" simply means a refresh operation of grayscale data in the display memory 120, as in the first embodiment.

If a negative determination is made in step S214, the display controller 130 determines whether or not the current value of the variable p is equal to the number of scanning lines 1410, that is, m (step S216).

If a negative determination is made in step S216, the display controller 130 increments the variable p by "1" (step S218) so that the next pixel row is read and scanned, and the routine returns to step S210.

If an affirmative determination is made in step S216, the display controller 130 terminates the present frame processing, and waits for the start of the next frame (step S22).

If it is determined in step S210 that the specific refresh has occurred, the display controller 130 sets the variable Mod to "1" (step S220) in order to switch the operation mode to the write (W) mode.

Then, the display controller 130 temporarily increases the frequency of the clock signal YCK after the scanning signal Yp supplied to the p-th row of the scanning lines 1410 transitions from the high level to the low level (step S222).

Then, the display controller 130 sets the variable Mod to "2" (step S224) in order to switch the operation mode in the next frame processing to the exclusive (X) mode. Thereafter, the display controller 130 terminates the present frame processing, and waits for the start of the next frame.

Specifically, if the specific refresh occurs during the reading and scanning operation for the p-th row, the frame processing terminates without performing the reading and scanning operation for the (p+1)-th row. Therefore, the grayscale data for the pixels from the (p+1)-th row to the last or m-th row are not read from the display memory 120.

Furthermore, since the scanning signals supplied to the (p+1)-th row to the last or m-th row of the scanning lines 1410 become high only for an instant, the densities of the liquid crystal elements 1470 from the (p+1)-th row to the last or m-th row are maintained from the previous frame. Thus, the content displayed by the pixels 1400 from the first row to the last or m-th row does not change even if the display memory 120 is refreshed during the reading and scanning period for the first row to the m-th row.

In the normal (N) mode, therefore, the reading and scanning operation is performed in turn from the first row to the m-th row to read the grayscale data, and the read grayscale data is converted into an analog signal having a polarity indicated by the polarity-indicator flag Pol before the analog signal is written to the pixels 1400. If the specific refresh occurs during the reading and scanning period for the first row to the m-th row, however, the operation mode switches to the write (W) mode, so that the reading and scanning operation for rows subsequent to the row at which the specific refresh occurred is skipped. Thus, the display by the pixels 1400 in the skipped rows does not change.

If it is determined in step S204 that the value of the variable Mod is not "0", the display controller 130 further determines whether or not the value of the variable Mod is "2", that is, whether or not the operation mode is the exclusive (X) mode (step S206).

The variable Mod is set to "2" only when the initial operation mode in the previous frame processing is the normal (N) mode, or only when it is a skip (S) mode described below in detail and the specific refresh occurred (step S224).

In a frame next to the frame in which the specific refresh occurred, therefore, the read processing in the exclusive (X) mode shown in FIG. 15 is performed.

First, similarly to the normal (N) mode operation in step S210, the display controller 130 performs the reading and scanning operation for a pixel row specified by the variable p (step S240). This scanning process allows the grayscale data for one row of pixels on the p-th row, from the first to n-th columns, to be sequentially read from the display memory 120 and then supplied to the X driver 160, as in the normal (N) mode operation in step S210.

After the grayscale data in the p-th row and the n-th column has been read, the display controller 130 outputs the signal AK at the level of a write polarity indicated by an inverse of the value set for the register L-p (step S241) before outputting the latch pulse LP.

Namely, in the exclusive (X) mode, when the grayscale data for one row of pixels in the p-th row is read, the grayscale data is converted into an analog signal having a polarity opposite to the polarity of the previously written data, regardless of the write polarity indicated by the polarity-indicator flag Pol. The resulting analog signal is actually written to the pixels 1400 in the p-th row.

In order to record the write to the pixels 1400 in the p-th row with a polarity indicated by an inverse of the value set for the register L-p in the present frame processing, the display controller 130 rewrites the value set for the register L-p to an inverse thereof (step S242).

Then, the display controller 130 determines whether or not the current value of the variable p is equal to the number of scanning lines 1410, that is, m (step S256).

If a negative determination is made in step S256, the display controller 130 increments the variable p by "1" (step S258) so that the next pixel row is read and scanned, and the routine returns to step S240.

If an affirmative determination is made in step S256, the display controller 130 sets the variable Mod to "3" (step S260) in order to switch the operation mode in the next frame processing to the skip (S) mode. Then, the display controller 130 terminates the present frame processing, and waits for the start of the next frame (step S22).

In the exclusive (X) mode, therefore, the reading and scanning operation is performed in turn from the first row to the m-th row to read the grayscale data, and the read grayscale data is converted into an analog signal having a polarity opposite to the polarity of the previously written data, regardless of a polarity indicated by the polarity-indicator flag Pol, and is then written to the pixels 1400.

Meanwhile, if the display controller 130 determines in step S206 that the value of the variable Mod is not "2", the value of the variable Mod is limited to "3" in the second embodiment. The value of the variable Mod can be "1" (step S220), in which case the variable Mod is set again to "2" immediately before the write (W) mode terminates (step S224), so that the value of the variable Mod can only be one of "0", "2", and "3" at the time of determination in steps S204 and S206.

The value of the variable Mod is "3" at the start of frame processing only when the operation mode in the previous frame processing is the exclusive (X) mode.

In a frame next to the frame in which the frame processing is performed in the exclusive (X) mode, therefore, the read processing in the skip (S) mode shown in FIG. 16 is performed.

First, the display controller 130 determines whether or not the value of the register L-p in a row specified by the variable p matches the value indicated by the polarity-indicator flag Pol (step S270).

As described above, when a data signal is actually written to an i-th row of pixels, a value indicating the polarity of that data signal is set for the register L-i in the i-th row. Thus, it is determined in step S270 whether or not the write polarity in the previous frame (that is, in the exclusive (X) mode) matches the inherent write polarity in the present frame.

If an affirmative determination is made in step S270, the display controller 130 causes the routine to proceed to step S286, as described below, in order to reduce or avoid reading of the same grayscale data and the write with the same polarity.

On the other hand, if a negative determination is made in step S270, as in steps S210 and S240, the display controller 130 performs the reading and scanning operation for a pixel row specified by the variable p (step S280). This scanning process allows the grayscale data for one row of pixels on the p-th row, from the first to n-th columns, to be sequentially read from the display memory 120 and then supplied to the X driver 160, as in steps S210 and S240.

After this read processing, as in step S211, the display controller 130 outputs the signal AK at the level of a write polarity indicated by the polarity-indicator flag Pol before outputting the latch pulse LP (step S281). When the latch pulse LP is output, the read grayscale data is converted into an analog signal having the inherent write polarity indicated by the polarity-indicator flag Pol, and is then written to the pixels 1400 in the p-th row.

In order to record the writing operation, the display controller 130 rewrites the value of the register L-p to the value of a write polarity indicated by the polarity-indicator flag Pol (step S282).

Then, the display controller 130 determines whether or not a specific refresh has occurred during the reading and scanning operation in step S280 (step S284).

If an affirmative determination is made in step S284, the routine proceeds to step S220 described above, and the display controller 130 causes the operation mode to be switched to the write (W) mode.

On the other hand, if a negative determination is made in step S284, the display controller 130 determines whether or not the current value of the variable p is equal to the number of scanning lines 1410, that is, m (step S286).

If a negative determination is made in step S286, the display controller 130 increments the variable p by "1" (step S288) so that the next pixel row is read and scanned, and the routine returns to step S270.

If an affirmative determination is made in step S286, the display controller 130 sets the variable Mod to "0" (step S290) in order to return the operation mode in the next frame processing to the normal (N) mode. Then, the display controller 130 terminates the present frame processing, and waits for the start of the next frame (step S22).

In the skip (S) mode, therefore, the reading and scanning operation is performed in turn from the first row to the m-th row to read the grayscale data, and the read grayscale data is converted into an analog signal having the inherent polarity indicated by the polarity-indicator flag Pol, and is then written to the pixels 1400. If the polarity set for the register L-p is the same as a polarity indicated by the polarity-indicator flag Pol, however, the reading and scanning operation and the writing operation for the p-th row are skipped. If the specific refresh occurs during the reading and scanning operation, the operation mode is switched to the write (W) mode, and the reading and scanning operation for the next and following rows is skipped, so that the display by the pixels 1400 in the skipped rows does not change, as in the normal (N) mode.

<Specific Operation>

The specific operation of the display method according to the second embodiment is now described. FIG. 17 is a chart showing, on a frame basis, how the grayscale data is read from the display memory 120 according to the display method.

In FIG. 17, alphabet letters denote displayed patterns, and symbol "+" or "−" which follows the alphabet letters denotes the actual write polarity with respect to pixels.

As described above, the inherent write polarity with respect to a pixel is indicated by the polarity-indicator flag Pol, and is positive in an odd-numbered frame and negative in an even-numbered frame in the second embodiment.

Therefore, the grayscale data of pattern A read in frame 1 is converted into an analog data signal with the positive polarity and is then written to the pixels. The grayscale data of pattern A read in the next frame or frame 2 is converted into a data signal with the negative polarity and is then written to the pixels.

In frame 3, the grayscale data of pattern A from the first row to the eighth row is read and converted into a data signal with the negative polarity, and is then written to the pixels. Since a specific refresh into pattern B occurs when the grayscale data in the eighth row is being read and scanned (since an affirmative determination is made in step S214 if the value of the variable p is "8"), the reading and scanning operation for the ninth and following rows is skipped (step S222). Thus, the pattern A written with the positive polarity in frame 2 is maintained in the pixels in the ninth and following rows, thus preventing display tearing.

Since a specific refresh occurs in frame 3, frame 4 is in the exclusive (X) mode. The grayscale data of pattern B in the first row to the eighth row read in frame 4 is converted into a data signal having the negative polarity which is not the inherent write polarity and which is opposite to the write polarity in frame 3, and is then written to the pixels. Since frame 4 is an even-numbered frame and the inherent write polarity is also negative, it is not necessary to discuss as to whether or not the writing operation for the first row to the eighth row in frame 4 should be performed with the inherent write polarity.

In frame 3, the data signal is not written to the pixels in the ninth and following rows because the reading and scanning operation has been skipped, and the values of the register L-9 and the following registers still indicate the write with the negative polarity which is set in frame 2. Thus, the grayscale data of pattern B in the ninth and following rows read in frame 4 is converted into a data signal having the positive polarity which is not the inherent write polarity and which is opposite to the write polarity in frame 2, and is then written to the pixels.

Since frame 4 is in the exclusive (X) mode, frame 5 is in the skip (S) mode. Hence, the grayscale data of pattern B in the first row to the eighth row read in frame 5 is converted into a data signal having the positive polarity opposite to the write polarity in frame 4, i.e., the inherent write polarity, and is then written to the pixels.

The grayscale data of pattern B in the ninth and following rows in frame 4 is converted into a data signal with the positive polarity and is then written to the pixels. Thus, in frame 5, the values of the register L-9 and the following registers still indicate the write with the positive polarity.

The values of the register L-9 and the following registers match the inherent write polarity in frame 5 (an affirmative determination is made in step S270 if the value of the variable p is "9" or greater), and the reading operation for the ninth and following rows is skipped.

Since frame 5 is a skip (S) mode frame in which a specific refresh does not occur, frame 6 is again in the normal (N) mode. The grayscale data of pattern B read in frame 6 is converted into a data signal having the negative polarity that is the inherent write polarity, and is then written to the pixels.

Frame 5 is an exemplary skip (S) mode frame in which a specific refresh does not occur. However, of course, a skip (S) mode frame in which a specific refresh occurs is also available.

Examples of such a frame include frames 12, 17, and 19 in FIG. 17.

Out of these frames, frame 19 indicates the following four states, in particular. In a first state, since a negative determination is made in step S270 when the value of the variable p ranges from "1" to "6" in frame 19, the grayscale data of pattern G in the first row to the sixth row is converted into a data signal having a polarity opposite to the write polarity in frame 18, that is, the inherent or positive polarity, and is then written to the pixels. In a second state, since an affirmative determination is made in step S270 when the value of the variable p ranges from "7" to "8", the reading and scanning operation for the seventh and eighth rows is skipped. In a third state, since a negative determination is made again in step S270 when the value of the variable p ranges from "9" to "1", the grayscale data of pattern G in the ninth-row to the 12th row is converted into a data signal having the positive polarity that is opposite to the write polarity in frame 18, and is then written to pixels. In a fourth state, since an affirmative determination is made in step S284 when the value of the variable p is "1", the reading and scanning operation for the 13th and following rows is skipped (step S222).

If a specific refresh occurs in a frame which is in the skip (S) mode, the operation mode is switched to the write (W) mode so that the next frame is in the exclusive (X) mode, followed by the skip (S) mode. If the specific refresh does not occur in the skip (S) mode, the operation mode is switched again to the normal (N) mode.

In the second embodiment, therefore, similarly to the first embodiment, display tearing does not occur even if a refresh occurs during the reading and scanning operation, thereby making it possible to prevent a reduction in the display quality. According to the second embodiment, furthermore, a data signal having an inverted polarity is written to a pixel corresponding to an address in which the reading and scanning operation is skipped, thus avoiding consecutive writing with the same polarity. Therefore, the second embodiment can reduce or prevent a reduction in the display quality, and can also reduce or prevent a reduction in the liquid crystal characteristic due to an application of DC component to liquid crystal elements.

In the second embodiment, the inherent write polarity is simply inverted every frame, while the same polarity is provided in adjacent rows. In addition to such inversion, as shown in FIG. 18, the write polarity may be inverted every row. In order to invert the write polarity every row, internal processing should be performed so that, for example, the polarity-indicator flag Pol indicates the positive polarity for an odd-numbered row in an odd-numbered frame and the negative polarity for an even-numbered row in an odd-numbered frame, and indicates the negative polarity for an odd-numbered row in an even-numbered frame and the positive polarity for an even-numbered row in an even-numbered frame. The polarities for adjacent columns may further be inverted.

<Application Example>

The present invention is not limited to the foregoing first and second embodiments, and a variety of applications or modifications may be made.

In the foregoing first and second embodiments, it is determined that a specific refresh has occurred if the grayscale data is refreshed in the display memory 120. One reason is that it is possible to indirectly know, from the presence or absence of received instruction WCM, whether or not the grayscale data is refreshed in the display memory 120 since the grayscale data is refreshed in the display memory 120 upon receipt of the instruction WCM from the host control circuit 110.

However, display tearing as above described does not necessarily occur once the grayscale data is refreshed in the display memory 120. In other words, depending upon the relation between the read and scanned range and the refreshed region, there is possibility that display tearing does not occur.

Figure 19:
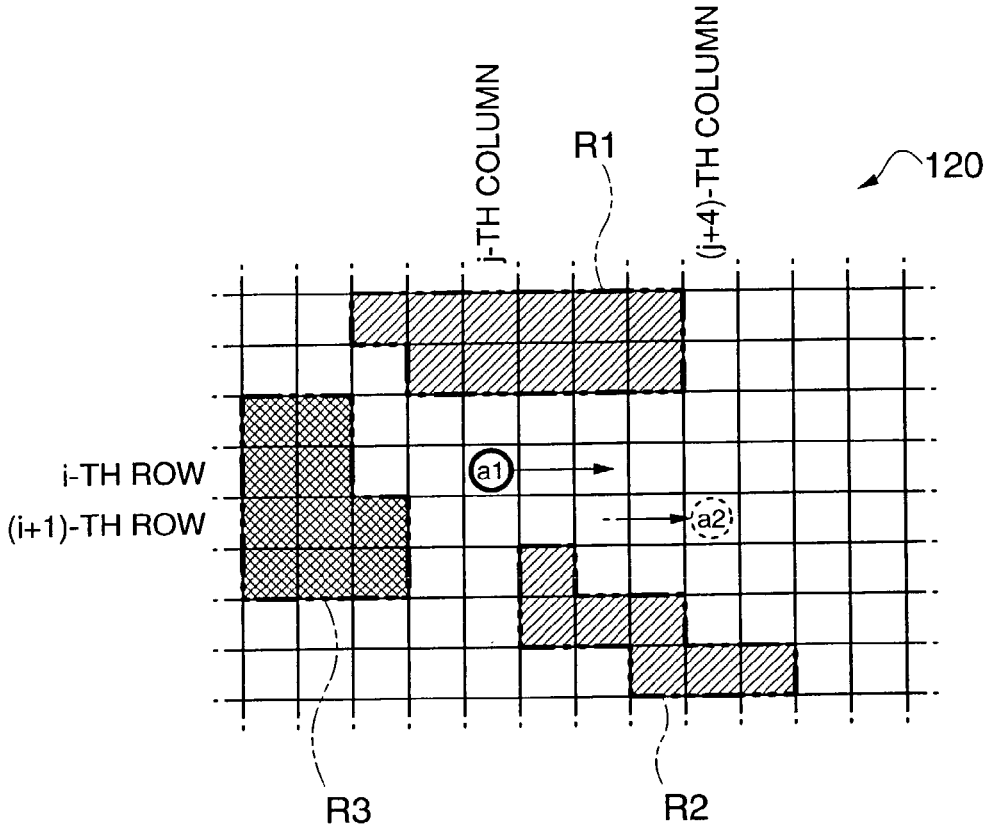
FIG. 19 is a chart describing another example for determination of a specific refresh in the first or second embodiment.

For example, as shown in FIG. 19, it is assumed that, in a frame, a reading address Rad from the display memory 120 corresponds to an address (a1) in which grayscale data of the pixel in the i-th row and the j-th column is stored. When the grayscale data is refreshed, if all addresses in the refreshed range, such as a range R1, have been read and scanned in this frame, display tearing does not occur since the refreshed range is read and scanned in the next frame.

Furthermore, it is assumed that, if, in a frame, the reading address Rad when the grayscale data was refreshed corresponds to an address (a1), the reading address when the refresh is completed will proceed to an address (a2) in which the grayscale data of the pixel in the (i+1)-th row and the (j+4)-th column is stored. In this case, if all addresses in the refreshed range, such as a range R2, precede the predicted address (a2), display tearing does not occur since the refreshed range is read and scanned in this frame.

However, in a frame, if all addresses in the refreshed range, such as a range R3, has not been read and scanned, or if all addresses in the refreshed range do not precede the predicted address, the refreshed range is separated into a group of addresses which are read and scanned in this frame and a group of addresses which are not read and scanned in this frame, resulting in the occurrence of display tearing.

In a preferred form, therefore, for example, upon receipt of the instruction WCM, the display controller 130 finds a refreshed range from the instruction WCM, and predicts, from the number of addresses included in the refreshed range, the time required to refresh the data, while assuming the distance by which the reading address when the instruction WCM was received progresses as the predicted time elapses. Until it is determined, from the reading addresses, the refreshed range, and the assumed address, that none of the above cases is applied, it is not determined that a specific refresh, which can reduce the display quality due to display tearing, has occurred.

In the first and second embodiments, it is always assumed that all rows are possibly refreshed. Thus, if a specific refresh occurs during the reading and scanning period for a row in a frame, the reading and scanning operation for the following rows in this frame is skipped. Depending upon conditions or settings, the grayscale data may be refreshed only in a predetermined row.

In the case where the grayscale data is refreshed only in a predetermined row, the reading and scanning operation may be skipped only in a range including the predetermined row when the grayscale data is refreshed.

For example, FIG. 20 shows an example where the reading and scanning operation is skipped only in a range of the fourth row to the 15th row when the grayscale data is refreshed in the case where the range of the fourth row to the 15th row is possibly refreshed (during the reading and scanning operation).

In the first and second embodiments, the reading address from the display memory 120 stops progressing when the reading and scanning operation is skipped. However, it may not be necessary to stop progressing the reading address. If the address does not stop progressing, the grayscale data is actually read; the skipped row is not substantially selected by the Y driver 150, thereby disabling the write to the pixels 1400.

When the reading and scanning operation is skipped, the frequency of the clock signal YCK is temporarily increased so that the period in which the skipped row is selected (the period during which the scanning signal is high) is shortened, thereby requiring a certain time for skipping.

Ideally, a reset mechanism is provided in each of the transfer units 1515 in the Y driver 150 because the selection time for skipped rows is not required.

Otherwise, in FIG. 3, if the reading and scanning operation is skipped in a period in which, inherently, the output of the transfer unit 1515 is high and any of the scanning lines 1410 is selected, the output of the transfer unit 1515 may be forcibly made low so that the scanning lines 1410 are not selected. In such a configuration, for example, a two-input AND circuit may be provided between the output of the transfer unit 1515 and the corresponding scanning line 1410. More specifically, the configuration may be such that an output signal of the transfer unit 1515 is supplied to one input of the two-input AND circuit, and a skip control signal is supplied to the other input, while an output signal of the AND circuit is supplied to the scanning line 1410. With this configuration, if the transfer unit 1515 corresponding to a certain row of the scanning lines 1410 outputs a high-level signal indicating that this row is to be selected, the output of the two-input AND circuit is forcibly made low by making the skip control signal low in order to skip this row, so that this row of the scanning lines 1410 is not selected. It is therefore unnecessary to increase the frequency of the clock signal YCK.

However, the provision of reset mechanisms or two-input AND circuits increases the complexity in configuration accordingly. In fact, it is a matter of choice, taking a variety of conditions into account, whether or not reset mechanisms or two-input AND circuits are provided in the configuration of the Y driver, and, if not provided, it is further a matter of choice to which extent the frequency of the clock signal YCK for skipping increases compared to the frequency for not skipping.

Although the present invention has been discussed in the context of an EL device or a liquid crystal device, it is to be understood that the present invention is not limited thereto. For example, electrooptical devices using Digital Micromirror Device™ (DMD) or a variety of electrooptical elements using fluorescence caused by plasma emission or electron emission, and electronic equipment having such electrooptical devices may also fall within the scope of the invention.

[Advantages]

As described above, according to the present invention, grayscale data can be written to a display memory independently of scanning using reading addresses, thereby reducing the load on a host control circuit for performing this writing operation. In addition, the reading operation is skipped at an address at which a specific refresh, which possibly causes a reduction in the display quality, occurred, and the gray scale specified by the previously read grayscale data is maintained in the pixel corresponding to that address. Thus, tearing of display image can be reduced or prevented, resulting in no reduction in the display quality of moving pictures. Therefore, a reduction in the display quality can be reduced or prevented without an increased load on the host control circuit.

What is claimed is:

1. An image display method, comprising:

specifying reading addresses from a display memory in an order synchronous with vertical scanning and horizontal scanning of a display panel, the display memory having addresses corresponding to individual pixels in the display panel, the addresses storing grayscale data specifying a gray level of the pixel corresponding to each address;

sequentially reading the grayscale data from the reading addresses and setting the pixels of the display panel to the gray level specified by the grayscale data;

determining if a specific refresh occurred in the display memory during a reading and scanning period in which the reading addresses are specified; and skipping the reading of the grayscale data at least from an address subsequent to the address at which the specific refresh occurred;

maintaining a pixel corresponding to the skipped address at the gray level specified by grayscale data read before the reading and scanning period, if it is determined that the specific refresh occurred; and while skipping the reading of the grayscale data, increasing a frequency of a clock signal for vertical scanning of the display panel to a much higher frequency than a frequency of the clock signal when reading grayscale data.

2. The image display method according to claim 1, the determining step further comprising, determining that the specific refresh occurred regardless of the reading address being specified at the time the specific refresh occurred.

3. The image display method according to claim 1, the skipping step comprising:

skipping the reading for rows subsequent to the row including the reading address at the time when the determination is made; and maintaining the pixels in the skipped rows at the gray level specified by grayscale data read before the reading and scanning period, if it is determined that the specific refresh occurred.

4. The image display method according to claim 3, further comprising:

inverting a write polarity of a pixel at least every one vertical scanning period according to a polarity-indicator flag that indicates the write polarity; and writing, in a reading and scanning period subsequent to the reading and scanning period in which the specific refresh occurred, a pixel corresponding to the skipped address with a polarity opposite to the polarity in the reading and scanning period in which the specific refresh occurred, regardless of the polarity-indicator flag; and skipping a subsequent reading operation from the address corresponding to the opposite polarity written pixel, and maintaining the opposite polarity written pixel corresponding to the skipped address at the gray level written with the opposite polarity, when the opposite write polarity for the pixel is the same as the write polarity indicated by the polarity-indicator flag during a reading and scanning period subsequent to the reading and scanning period in which the pixel was written with the opposite polarity.

5. An image display device, comprising:

a display panel including individual pixels;

a display memory having addresses corresponding to individual pixels in the display panel, the addresses storing grayscale data specifying a gray level of the pixel corresponding to each address;

a specifying device that specifies reading addresses from the display memory in an order synchronous with vertical scanning and horizontal scanning of the display panel;

a reading device that sequentially reads the grayscale data from the reading addresses and sets the pixels of the display panel to the gray level specified by the grayscale data;

a determining device that determines if a specific refresh occurred in the display memory during a reading and scanning period in which the reading addresses are specified;

a first maintaining device that skips the reading of the grayscale data at least from an address subsequent to the address at which the specific refresh occurred, and maintains a pixel corresponding to the skipped address at the gray level specified by grayscale data read before the reading and scanning period, if it is determined by the determining device that the specific refresh occurred; and while skipping the reading of the grayscale data, increasing a frequency of a clock signal for vertical scanning of the display panel to a much higher frequency than a frequency of the clock signal when reading grayscale data.

6. The image display device according to claim 5, wherein the determining device determines that the specific refresh occurred regardless of the reading address being specified at the time the refresh occurred.

7. The image display device according to claim 5, wherein the first maintaining device skips the reading operation for rows subsequent to the row including the reading address at the time when the determination is made, and maintains the pixels in the skipped rows at the gray level specified by grayscale data read before the reading and scanning period, if it is determined that the specific refresh occurred.

8. The image display device according to claim 7, further comprising:

a polarity inverting device that inverts a write polarity of a pixel at least every one vertical scanning period according to a polarity-indicator flag to indicate the write polarity; and a writing device that writes, in a reading and scanning period subsequent to the reading and scanning period in which the specific refresh occurred, a pixel corresponding to the skipped address with a polarity opposite to the polarity in the reading and scanning period in which the specific refresh occurred, regardless of the polarity-indicator flag; and a second maintaining device that skips a subsequent reading operation from the address corresponding to the opposite polarity written pixel, and that maintains the opposite polarity written pixel corresponding to the skipped address at the gray level written with the opposite polarity, when the opposite write polarity for the pixel corresponding to the skipped address is the same as the write polarity indicated by the indication during a reading and scanning period subsequent to the reading and scanning period in which the writing operation was performed by the writing device.

9. Electronic equipment, comprising the image display device according to claim 5.

* * * * *